United States Patent [19]

Okushita

[11] Patent Number: 4,560,090

[45] Date of Patent: Dec. 24, 1985

[54] BAG-IN-BOX PACKAGE

[75] Inventor: Masataka Okushita, Tokyo, Japan

[73] Assignee: Dai Nippon Insatsu Kabushiki Kaisha, Japan

[21] Appl. No.: 423,438

[22] Filed: Sep. 24, 1982

Related U.S. Application Data

[62] Division of Ser. No. 236,547, Feb. 20, 1981, Pat. No. 4,386,923.

[30] Foreign Application Priority Data

| | | | |
|---|---|---|---|
| Feb. 22, 1980 | [JP] | Japan | 55-21176 |
| Feb. 22, 1980 | [JP] | Japan | 55-22041[U] |
| Apr. 24, 1980 | [JP] | Japan | 55-56090[U] |
| May 22, 1980 | [JP] | Japan | 55-68186 |
| Jul. 22, 1980 | [JP] | Japan | 55-104127[U] |

[51] Int. Cl.[4] ..... B67B 7/24; B65D 35/56

[52] U.S. Cl. ..... 222/81; 220/463; 222/105; 222/183

[58] Field of Search ..... 220/462, 463, 465; 229/7 R, 17 R; 222/81, 91, 105, 183, 386.5

[56] References Cited

U.S. PATENT DOCUMENTS

| | | | |
|---|---|---|---|
| 2,200,818 | 5/1940 | Bergstein | 220/463 |
| 2,412,544 | 12/1946 | Waters | 220/462 |
| 3,054,549 | 9/1962 | Humphrey | 220/462 |
| 3,090,526 | 5/1963 | Hamilton et al. | 222/105 |
| 3,167,210 | 1/1965 | Carney | 220/465 |
| 4,146,152 | 3/1979 | Ogawa et al. | 221/81 |
| 4,165,023 | 8/1979 | Schmit | 222/183 |

FOREIGN PATENT DOCUMENTS

| | | | |
|---|---|---|---|
| 993462 | 5/1965 | United Kingdom | 222/81 |

*Primary Examiner*—H. Grant Skaggs
*Attorney, Agent, or Firm*—Parkhurst & Oliff

[57] ABSTRACT

For the fabrication of a bag-in-box (BIB) package, there is first provided a semifinished, collapsed BIB package wherein a flattened bag is placed within a collapsed box and secured to at least one of its inside surfaces by means of an adhesive. After erecting the package, the bag is inflated into close internal contact with the box by introducing a gas under pressure through a fitment attached to the bag and projecting outwardly of the box. The opposite ends of the box are closed with sets of foldable end flaps, with the aid of an adhesive. Preferably, the bag is further secured to the inside surfaces of a pair of opposed ones of the four bottom end flaps of the box. The opposed pair of bottom flaps are held folded out during the introduction of the pressurized gas into the bag, in order that the bottom end portion of the inflated bag may make neat contact with the inside surfaces of the box. There is also disclosed herein an apparatus for thus fabricating the BIB package.

4 Claims, 47 Drawing Figures

BAG-IN-BOX PACKAGE

This is a division of application Ser No. 236,547 filed Feb. 20, 1981, now U.S. Pat. No. 4,386,923.

BACKGROUND OF THE INVENTION

This invention relates to packages in general and, in particular, to composite packages of the variety known as bag-in-box (BIB), in which bags for containing beverages and other food and non-food commodities are themselves housed in boxes or cartons for protection during shipping and storage. The invention is directed more particuarly to an improved BIB package per se and to a method of, and apparatus for, its fabrication.

In BIB packaging, as heretofore practiced in the industry, a desired product is first filed into the bags, as through a fitment permanently attached thereto, and the filled bags are then placed in boxes. dispenser mechanisms are fitted to the fitments projecting outwardly of the boxes.

An objection to this conventional practice, or rather to the construction of the BIB permitting such practice, is that the bags are in no way secured to the boxes and are therefore free to move therein. If the packaged commodity is a liquid or like highly mobile matter, in particular, the filled bags will undergo ready displacement relative to the boxes when subjected to sudden impulses, vibrations and other external forces during shipping or handling. The bags may then develop pinholes or may otherwise be ruptured.

SUMMARY OF THE INVENTION

The present invention seeks to overcome the above problem of the prior art and to provide an improved BIB package wherein the bag is firmly attached to the box against the possibility of displacement. The invention also seeks to provide a method of, and apparatus for, the most efficient manufacture of such improved BIB packages.

In the BIB package according to the invention, stated in brief, the bag is placed within the box before being filled, instead of being inserted therein after being filled, as has been the case heretofore. The bag is made of two substantially rectangular, superposed layers of flexible material hermetically sealed together, one of which is secured to at least one of the inside surfaces of the box by means of an adhesive. Further, the bag is inflated into close internal contact with the box, ready to receive a desired product as through a fitment attached thereto and projecting outwardly of the box.

Such being the improved construction of the BIB package, the product can be filled, through the fitment, into the inflated bag mounted in position within the box and adhering thereto. The subsequent closure of the fitment with a dispenser mechanism completes the packaging operation. Thus the invention eliminates the possibility of the undesired relative motion between bag and box during filling, shipping and handling.

The fabrication of the BIB package by the method and apparatus of this invention starts from its semifinished or knocked-down state, wherein the bag is placed flattened within the collapsed box and adhered to at least one of its inside surfaces. After erecting the semifinished package, germfree air or other gas under pressure is introduced into the bag thereby inflating the same into close internal contact with the box. The opposite ends of the box are closed with sets of foldable end flaps, normally with the use of an adhesive.

Preferably, the bag is secured not only to the inside surface of one of the four side panels of the box but also to those of a pair of opposed ones of its four bottom flaps. The opposed pair of bottom flaps are held folded out during the introduction of the pressurized gas into the bag through the fitment which is located close to its top end. Inflated in this manner, the bag will have its bottom end portion neatly held against the inside surfaces of the box. Moreover, after being filled, the bag will firmly stay in position within the box in spite of shocks and other stresses that may be applied to the package until the product is ultimately dispensed therefrom by the consumer.

The above and other features and advantages of this invention and the manner of attaining them will become more apparent, and the invention itself will best be understood, from the following description of illustrative embodiments thereof which is to be read with reference to the attached drawings.

BRIEF DESCRIPTION OF THE DRAWINGS

In the drawings:

FIGS. 24A through 29A are a series of elevational views explanatory of the sequential steps of the fabrication of the bag-and-box combination of FIG. 23 into the BIB package;

FIGS. 24B through 29B are a series of end elevational views corresponding to FIGS. 24A through 29A respectively;

DETAILED DESCRIPTION OF THE INVENTION

Figure 1:
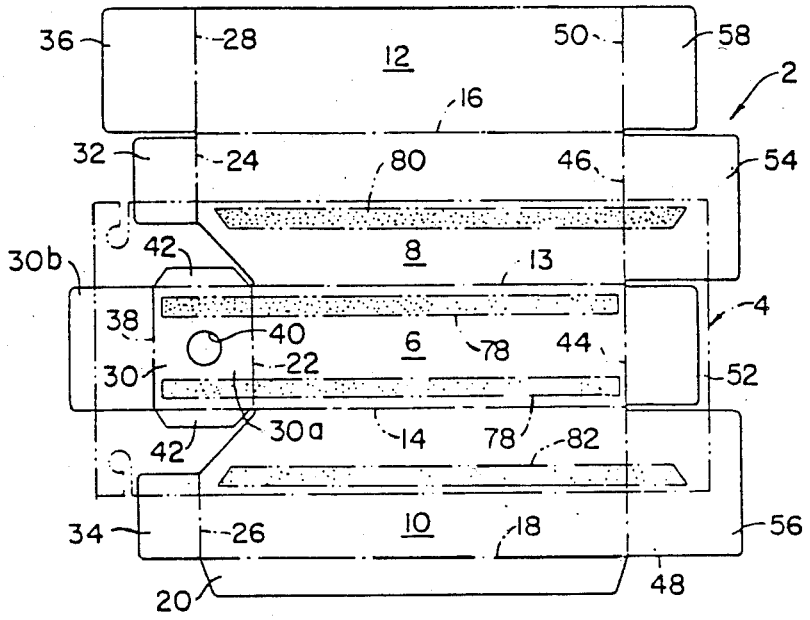
FIG. 1 is a developed plan view of an example of box forming a part of the BIB package according to this invention, the exemplified box being shown together with a phantom bag as attached in place to its inside surfaces.
Figure 2:
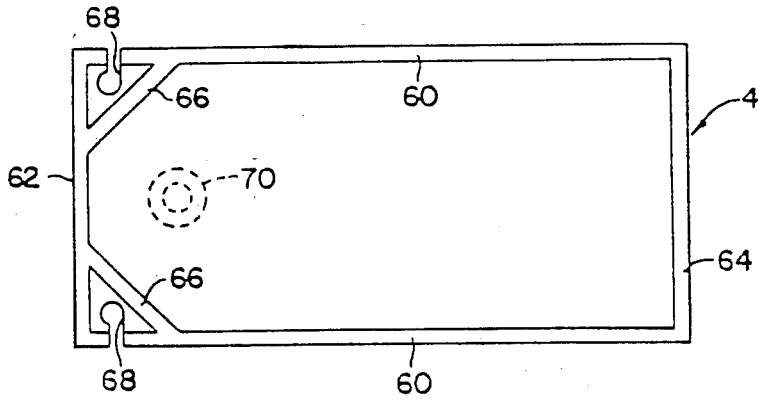
FIG. 2 is a plan view of the bag seen in FIG. 1, the bag being shown in a state before being inflated within the box.

The present invention pertains to the BIB package, and to the method and apparatus for its fabrication, typically composed of a box 2 shown in FIG. 1 and a bag 4 shown in FIG. 2. The illustration of FIG. 1 may be thought of either as a developed state of the box 2 or as a blank to be folded and connected into the box.

Referring more specifically to FIG. 1, the box 2 includes an integral set of four panels 6, 8, 10 and 12 to be folded and connected into a rectangualr tube. The first panel 6 is located between the second and third panels 8 and 10 and is set off therefrom by a pair of parallel foldlines 13 and 14. Another foldline 16 exists between the second and fourth panels 8 and 12 and extends parallel to the foldlines 13 and 14. The third panel 10 has a junction tab 20 extending sideways therefrom, with a foldline 18 therebetween which is parallel to the noted three foldlines.

A set of four end flaps 30, 32, 34 and 36 are hingedly or foldably connected to the left hand ends, as viewed in FIG. 1, of the panels 6, 8, 10 and 12 via foldlines 22, 24, 26 and 28, respectively. A foldline 38 divides the end flap 30 of the first panel 6 into portions 30*a* and 30*b*. Another set of four end flaps 52, 54, 56 and 58 are hingedly connected to the right hand ends of the panels 6, 8, 10 and 12 via foldlines 44, 46, 48 and 50, respectively.

When fabricated into the BIB package, the box 2 is intended to be placed uprightly on its right hand end as seen in FIG. 1. Thus the four left hand end flaps 30*b*, 32, 34 and 36 can be called the top flaps, and the four right hand end flaps 52, 54, 56 and 58 the bottom flaps. The flap 30*a* will be termed the bevel flap since it is to be oriented at an angle to the top flaps in the completed BIB package. The bevel flap 30*a* has a hole 40 formed approximately centrally therein and is provided with a pair of side tabs 42 foldably connected to its opposite edges at right angles with the foldlines 22 and 38.

It will be observed from FIG. 2 that the bag 4 is fabricated from two substantially rectangular, superposed layers or sheets of plastics or like flexible material. In this particular example the two rectangular plastics sheets are hermetically heat-sealed together along their marginal edges 60, 62 and 64. One of the plastics sheets, hidden behind the one seen in FIG. 2, has a fitment 70 attached thereto in a position of registry with the hole 40 (FIG. 1) in the bevel flap 30*a* of the bag 2.

Preferably, and as shown, the two constituent sheets or layers of the bag 4 are additionally heat-sealed together along diagonal lines 60 in the vicinity of the two corners at the top end of the bag. The triangular corner portions bounded by the sealing lines 60 have somewhat keyhole-shaped recesses 68 formed therein. These triangular corner portions could be cut off, however, as they serve no useful purposes.

Figure 3:
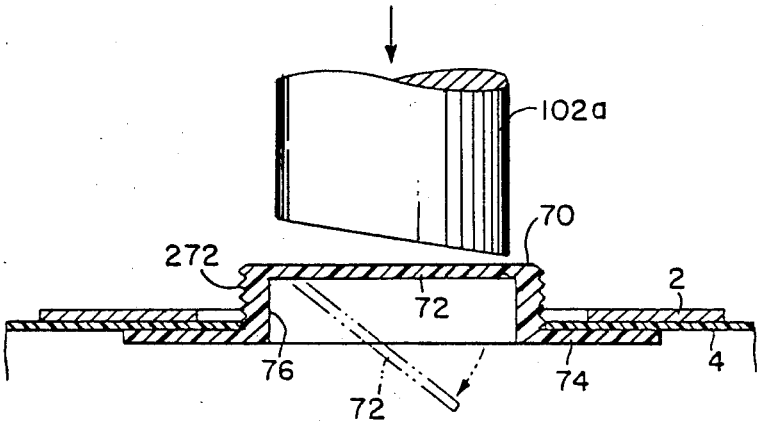
FIG. 3 is an enlarged sectional view of the fitment attached to the bag of FIG. 2, shown together with a punch for opening its end seal prior to its inflation.

FIG. 3 is an enlarged representation of the fitment 70 on the bag 4. The fitment is an integral molding of plastics material, in the shape of a short, hollow cylinder having a breakable seal 72 closing its outer end and a flange 74 on its inner end. The fitment 70 defines a passageway 76 for the introduction and dispensation of a beverage or other desired fluid product into and out of the bag. The flange 74 adheres to the inside surface of the bag 4 along its edge defining an opening that receives the fitment 70. The fitment opens as its end seal 72 is punched and deflected as indicated by the dot-and-dash lines.

With reference back to FIG. 1 the phantom bag 4 seen therein is illustrative of its placement on the inside surfaces of the box 2, such inside surfaces being shown directed toward the viewer in this figure. The bag 4 is still in a flat state of FIG. 2, and its fitment 70 extends through the hole 40 in the bevel flap 30*a* of the box. As placed in position on the inside surfaces of the box 2, the bag 4 overlies the first, second and third panels 6, 8 and 10, the bevel flap 30*a*, the first, second and third top flaps 30*b*, 32 and 34, and the first, second and third bottom flaps 52, 54 and 56. An adhesive is employed to attach the bag 4 to the first panel 6 and the bevel flap 30*a* at 78, to the second panel 8 and the second bottom flap 54 at 80, and to the third panel 10 and the third bottom flap 56 at 82. In this particular embodiment of the invention the firm attachment of the bag 4 at least to the bevel flap 30*a*, and perhaps to the first panel 6 as well, is essential. The adhesion of the bag to the second and third bottom flaps 54 and 56 is not mandatory but preferred, for reasons hereinafter made apparent.

Figure 4:
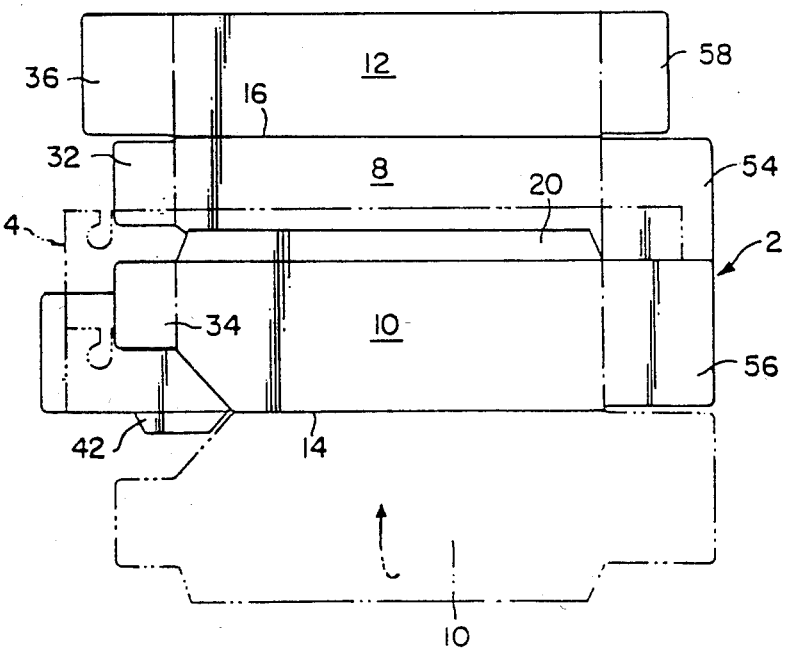
FIG. 4 is a view similar to FIG. 1 except that the box, together with the bag attached thereto, is shown folded along one of the foldlines between the four constituent panels of the box for the preparation of a semifinished package.

FIG. 4 shows the above prepared assembly of the box 2 and the bag 4 with the third panel 10 of the box, as well as the bag, subsequently folded inwardly along the foldline 14. Then, as pictured in FIG. 5, the fourth panel 12 of the box is folded inwardly along the foldline 16. The junction tab 20 of the previously infolded third panel 10 is united with the folded fourth panel 12 by means of an adhesive. FIG. 6 depicts the thus-folded box-and-bag assembly of FIG. 5 as seen from its rear side.

Figure 5:
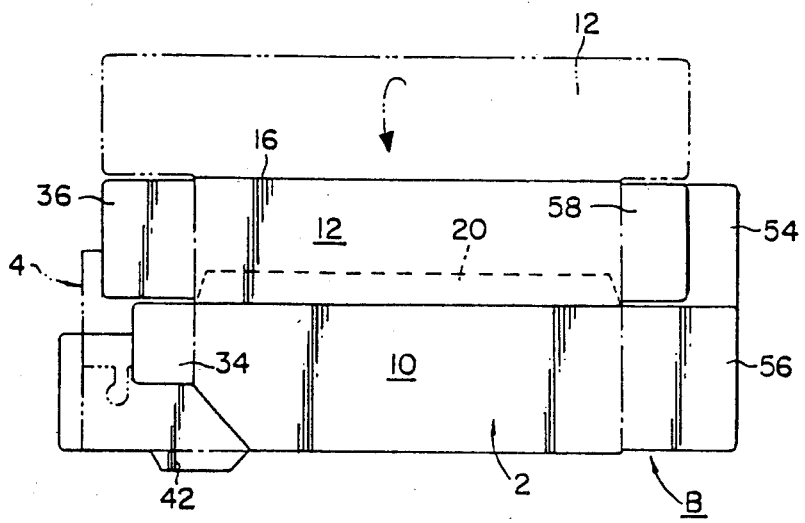
FIG. 5 is also a view similar to FIG. 1 except that the box is shown folded along another foldline to provide the semifinished package.
Figure 6:
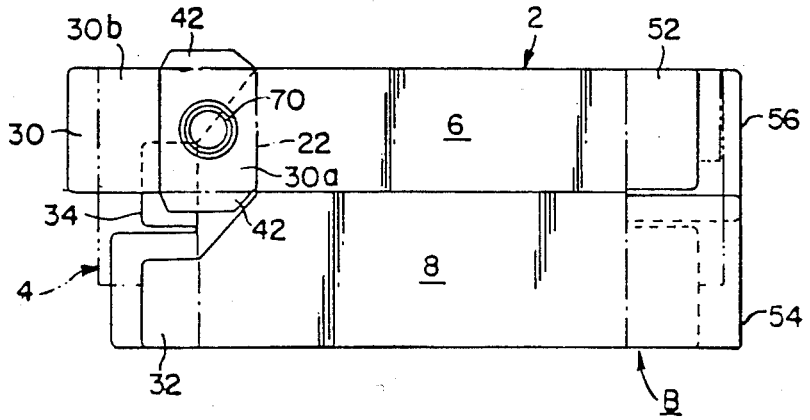
FIG. 6 is a rear view of the semifinished package.

It may now be pointed out that FIGS. 5 and 6 represent the semifinished BIB package, in a collapsed state, which is to be processed by the method and apparatus of this invention into the completed article ready to receive and contain a desired fluid product. In the semifinished, collapsed BIB package of FIGS. 5 and 6 the bag 4 is enveloped within the box 2 while being folded along a line approximately in coincidence with the foldline 14 of the bag. The fitment 70 on the bag partly projects outwardly of the bevel flap 30*a*, as will be noted from FIGS. 3 and 6.

What follows, then, is a description of a preferred form of the apparatus for constructing the BIB package from its semifinished, collapsed state of FIGS. 5 and 6. The method of this invention will also become evident from such description.

Figure 7:
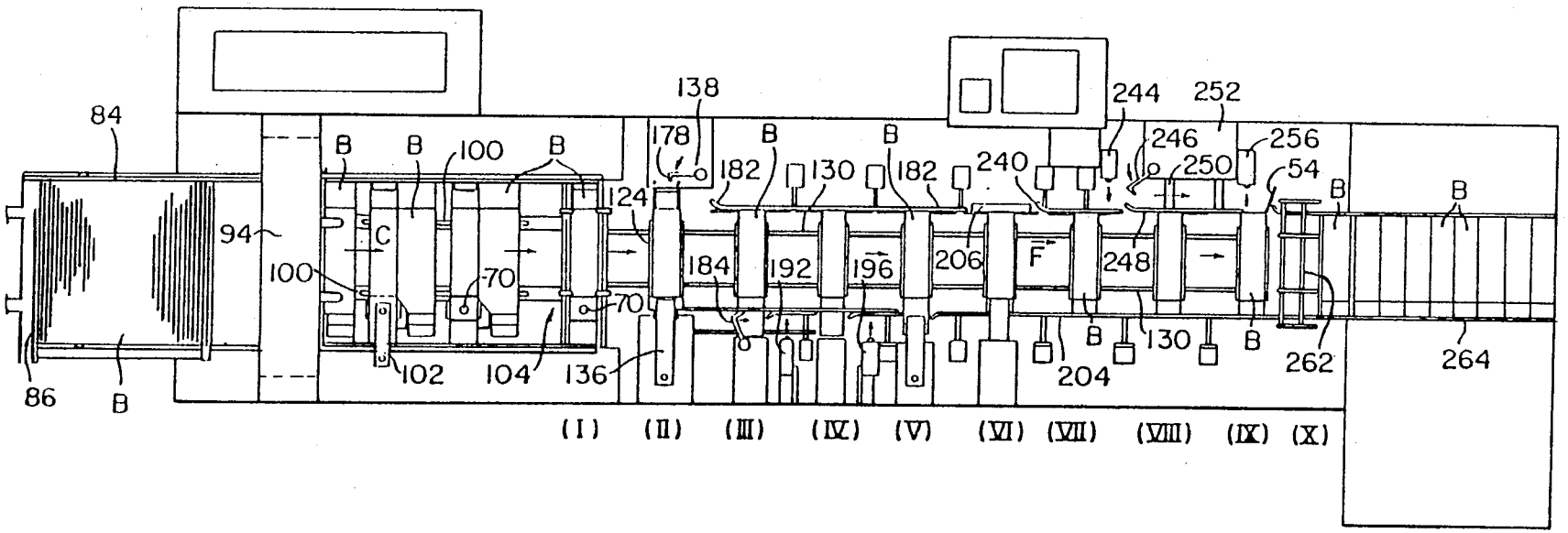
FIG. 7 is a top plan view of a preferred form of the apparatus for processing the semifinished package of FIGS. 5 and 6 into the completed BIB package in accordance with the method of this invention.
Figure 8:
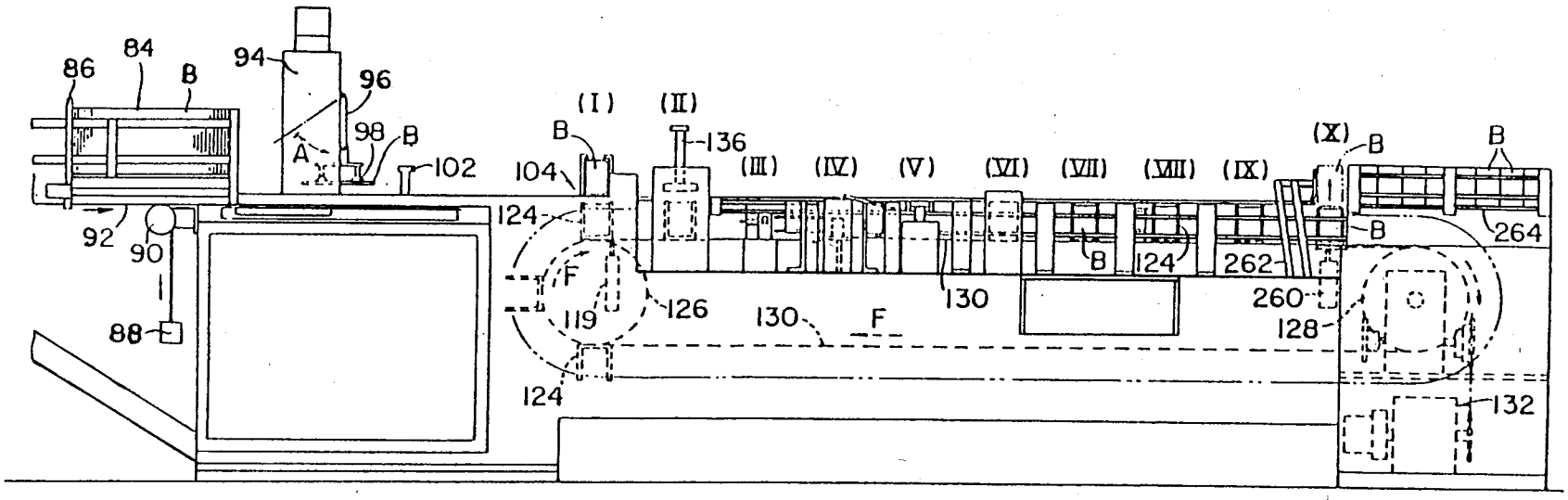
FIG. 8 is a side elevational view of the apparatus of FIG. 7.

FIGS. 7 and 8 illustrate, in top plan and side elevational views respectively, the preferred form of the apparatus in its entirety. At the left hand end of the apparatus, as viewed in these figures, there is disposed a standby rack 84 holding a multiplicity of semifinished, collapsed BIB packages B in a neat, horizontal file, with each package standing on one of its longitudinal edges. Slidably mounted in the standby rack 84 is a presser plat 86 connected to a string or strings 92 each extending over a guide roll 90 and terminating in a weight 88. Thus the weight or weights 88 constantly exert a rightward or forward force on the presser plate 86, causing the same to push the file of packages B in the same direction.

Mounted just forwardly of the standby rack 84 is an inverted U-shaped standard 94 supporting a pullout mechanism 96. This pullout mechanism is swingable as indicated by the double-headed arrow A in FIG. 8. A plurality of suction cups 98 at the free end of the pullout mechanism 96 cause adhesion thereto, by a partial vacuum created therein, of the foremost one of the BIB packages B in the standby rack 84 when the pullout mechanism is swung in a clockwise direction as viewed in FIG. 8. Subsequently pivoted back to the solid-line position in the same figure, the pullout mechanism 96 releases and deposits the package B horizontally on an infeed conveyor 100 better seen in FIG. 7.

As the pullout mechanism 96 repeats the foregoing cycle of operation, the BIB packages B are loaded one by one on the infeed conveyor 100, thereby to be transported forwardly, as indicated by the arrows C in FIG. 7, at constant spacings. It will be noted from FIG. 7 that each package B thus placed on the infeed conveyor 100 has its fitment 70 directed upwardly.

Lying immediately downstream of the pullout mechanism 96 is a punching mechanism 102 for breaking open the end seal 72 (FIG. 3) of the fitment 70 on each BIB package B. The punching mechanism 102 is mounted on one side of the infeed conveyor 100, toward which the top ends of the successive packages B are oriented, and overhangs the infeed conveyor. As seen also in FIG. 3, the punching mechanism 102 includes a punch 102*a*, which descends and pierces open the end seal 72 of the fitment 70 on each package B when it reaches a position just under the punching mechanism. The end seal 72 remains connected to the fitment 70 even after being punched in this particular embodiment. If desired or required, however, the end seal may be completely disconnected from the fitment and then removed as by suction.

It should be appreciated that the interior of the bag 4 of each BIB package B communicates with atmosphere only when the end seal 72 of its fitment 70 is opened by the punching mechanism 102. This is desirable to keep the possible contamination of the bag interior at a minimum. However, in cases where contamination presents no serious problem, the fitment may not necessarily be equipped with the end seal.

It has been stated that each semifinished BIB package B traveling on the infeed conveyor 100 is in the collapsed state of FIGS. 5 and 6. An erector mechanism 104 at the downstream end of the infeed conveyor 100 functions to cause each package to stand up and assume the proper rectangular cross-sectional shape.

Figure 9:
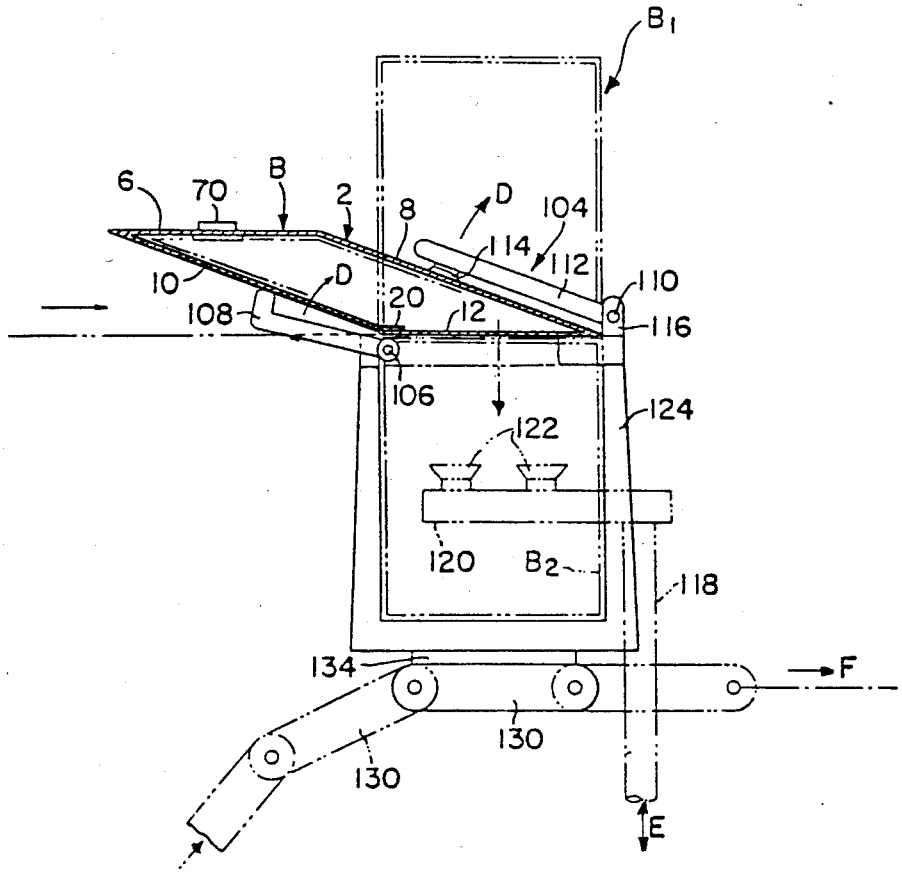
FIG. 9 is an enlarged side elevational view of an erector mechanism in the apparatus of FIGS. 7 and 8.

While FIGS. 7 and 8 both indicate the erector mechanism at 104, FIG. 9 more clearly reveals the details of this mechanism. It comprises one or more erector arms 108 pivotable about a horizontal axis at 106, and additional one or more erector arms 112 also pivotable about a horizontal axis at 110. These axes 106 and 110 are parallel to each other and transverse to the infeed conveyor 100. Each second mentioned erector arm 112 has a suction cup 114 affixed to its free end. Receiving each collapsed BIB package B at the downstream end of the infeed conveyor 100, the erector arms 108 and 112 are automatically pivoted as indicated by the arrows D, until the package gains the proper erect attitude shown at B1. A stop 116 limits the pivotal motion of the erector arms 108 and 112.

FIG. 9 also illustrates a pair of upright loading rods 118, one seen, movable up and down as noted by the arrow E. Each loading rod 118 has an arm 120 secured to its top end and extending horizontally so as to underlie one of the opposite ends of the erected BIB package at B1. Each arm 120 has one or more, two in the illustrated embodiment, suction cups 122 mounted thereon. Thus, when the pair of loading rods 118 are raised as by an actuator seen at 119 in FIG. 8, the two pairs of suction cups 122 on the arms 120 move into forced contact with the bottom, or the fourth panel 12, of the erected package at its opposite end portions. Upon subsequent descent of the loading rods 118 the package, adhering to the suction cups 122, is lowered from position B1 to position B2.

In this position B2, the package B is loaded in one of a series of cradles 124 hereinafter set forth. Each cradle 124 is channel-shaped, with a size to neatly receive and hold the package in the erect attitude. The longitudinal dimension, transverse to the infeed conveyor 100, of the cradle 124 is less than that of the package B, so that the opposite ends of this package project beyond the cradle to an extent sufficient to overlie the two pairs of suction cups 122.

An inspection of FIGS. 7 and 8 will reveal that two endless loops of chain 130 extend over sprocket wheels 126 and 128. The sprocket wheels 126 are disposed under the erector mechanism 104. The other sprocket wheels 128, considerably distanced rightwardly from the sprocket wheels 126, are driven by a conventional drive mechanism 132 to move the chains 130 in the direction of the arrows F.

The aforesaid package cradles 124 are mounted at constant spacings on the two conveyor chain strands 130, with each cradle oriented transversely thereof, for joint movement therewith. FIG. 9 shows that each cradle 124 is secured to the links of the chain 130 via a mount 134. The package cradles 124 travel intermittently on the conveyor chain 130. Erected by the erector mechanism 104, the successive BIB packages B can therefore be loaded on the respective cradles while the latter are being held at a standstill under the erector mechanism. The cradles frictionally retain the packages against the possibility of accidental displacement.

The conveyor chain 130 with the cradles 124 thereon feed the successive semifinised, erected BIB packages through a series of ten processing stations labeled I through X in FIGS. 7 and 8. At these stations the packages undergo the necessary operations to be processed into the completed articles. How they are processed, and by what means, will become apparent from the following description, with reference directed mostly to FIGS. 7, 8, 10A and 10B.

Figure 10A:
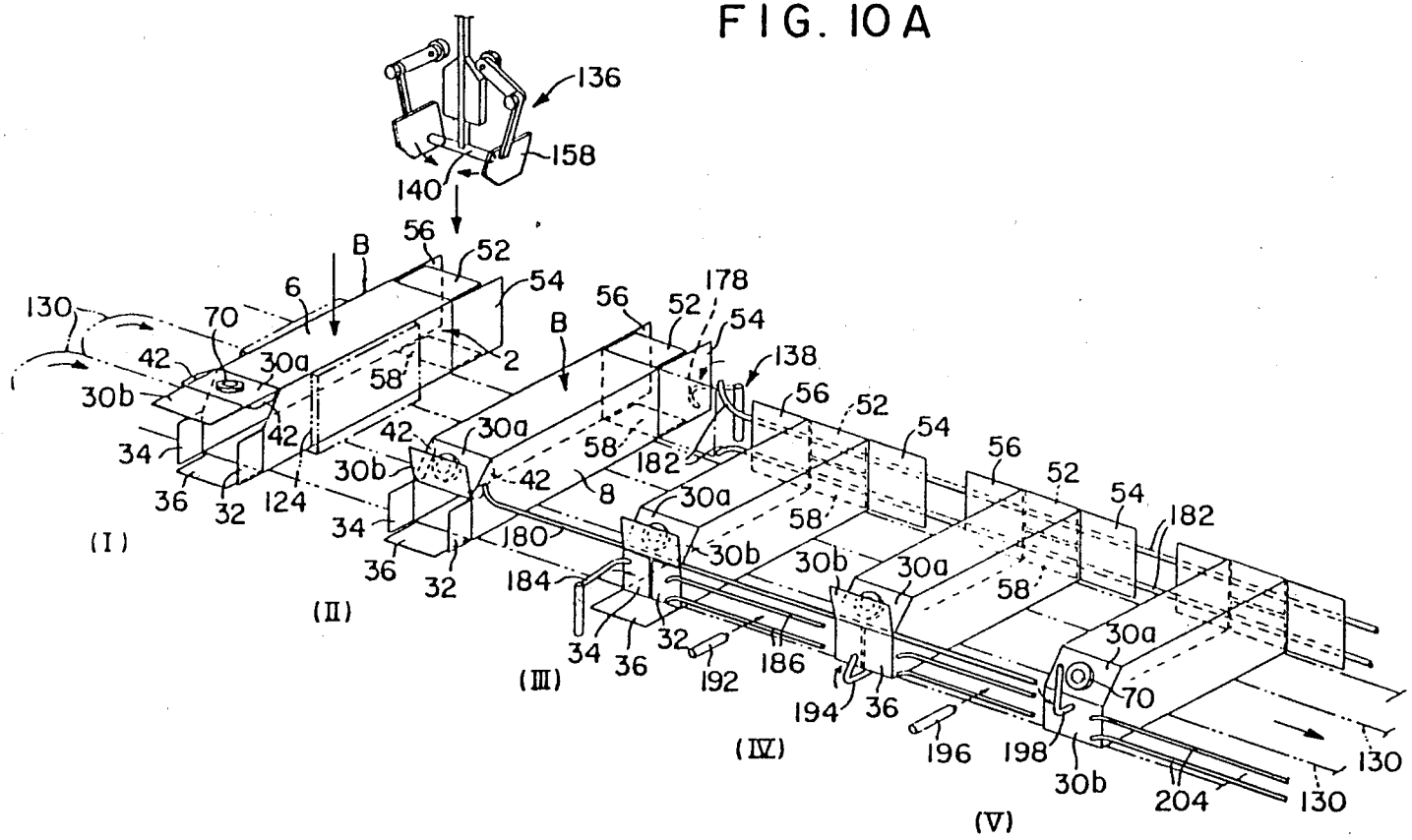
FIG. 10A is a perspective view explanatory principally of the operations to be performed on the successive semifinished packages in the first half of the apparatus of FIGS. 7 and 8.
Figure 11:
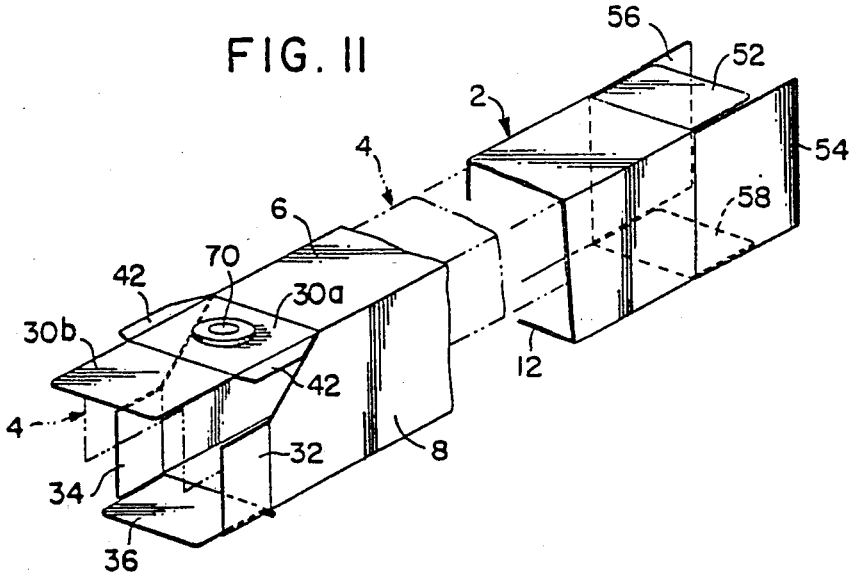
FIG. 11 is a perspective view, partly broken away for clarity, of the semifinished package as erected by the erector mechanism of FIG. 9.

At the first station I, located just under the erector mechanism 104, the package B lies horizontally on the fourth panel 12 of its box 2. As shown in FIG. 10A and in more detail in FIG. 11, the top and bevel flaps 30, 32, 34 and 36 and bottom flaps 52, 54, 56 and 58 all extend in coplanar relationship to the panels 6, 8, 10 and 12, respectively, at this station. The bag 4 assumes the shape of an inverted U as it adheres to the inside surfaces of the erected box 2.

At the next station II a folder mechanism 136 is disposed above and on one side of the chain conveyor for folding the bevel flap 30*a* as shown in FIG. 10A. Another folder mechanism 138 is provided on the opposite side of the conveyor for folding the second bottom flap 54 outwardly. The first recited folder mechanism 136 functions to fold the pair of side tabs 42 of the bevel flap 30*a* downwardly and to bend the bevel flap downwardly, thereby moving the side tabs into face-to-face relation with the inside surfaces of the second and third panels 8 and 10 as in FIG. 10A. The first top flap 30*b* becomes folded upwardly.

Figure 14:
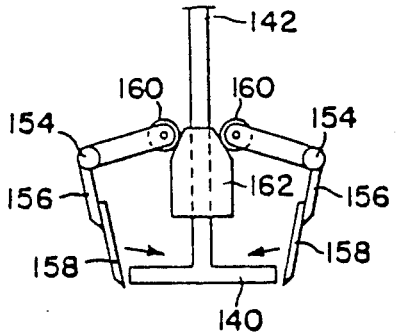
FIG. 14 is an elevational view showing some working parts of the folder mechanism of FIGS. 12 and 13 in order to facilitate the explanation of its operation.
Figure 12:
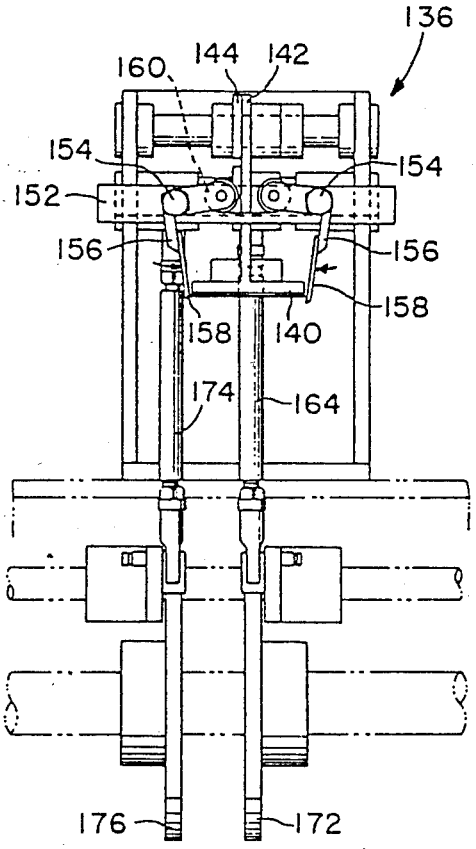
FIG. 12 is an enlarged elevational view of the folder mechanism in the apparatus of FIGS. 7 and 8.
Figure 13:
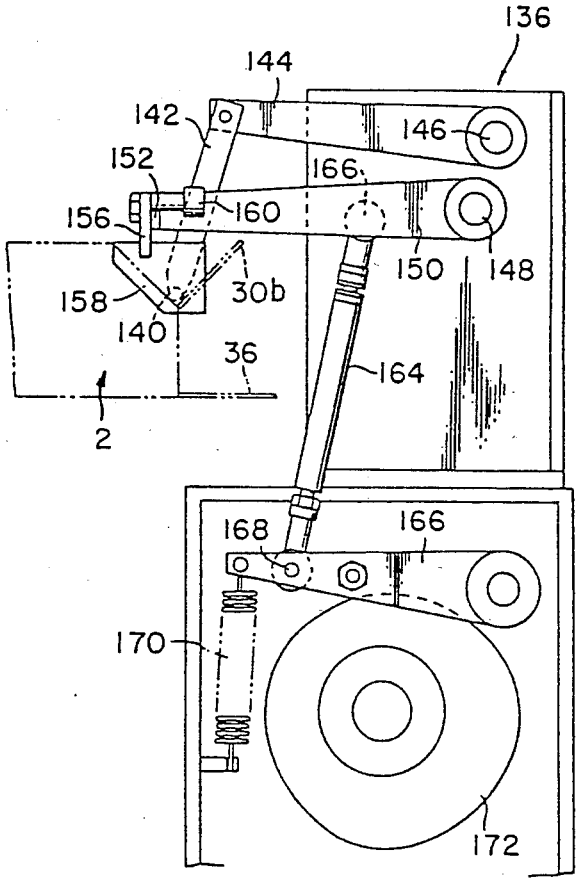
FIG. 13 is an elevational view showing the folder mechanism of FIG. 12 as seen from its right hand side.

FIGS. 12 and 13 illustrate the folder mechanism 136 in further detail. Seen at 140 in a T-shaped pusher having an upright bar 142 coupled to one end of a swing arm 144, the other end of which is coupled to a shaft 146 for pivotal motion in a vertical plane. Another shaft 148, parallel to the shaft 146, pivotally supports another swing arm 150, to the free end of which there is secured a horizontal bar 152 in right-angular relationship thereto. This bar 152 supports a pair of opposed bell cranks 156 at pivots 154. The depending arms of these bell cranks rigidly carry a pair of tab folder blades 158. The other arms of the bell cranks 156 extend toward each other, and each rotatably carries a cam follower roll 160 at its end. The cam follower rolls 160 engage a cam 162, FIG. 14, mounted on the bar 142 of the T-shaped pusher 140 intermediate between its ends.

A link 164 at its opposite ends is pivotally coupled at 166 to the swing arm 150 and at 168 to a cam follower lever 166. An extension spring 170 biases the cam follower lever 166 into engagement with a rotary cam 172. With the rotation of the cam 172, therefore, the swing arm 150 oscillates up and down together with the pair of tab folder blades 158 mounted thereon. A similar cam mechanism, including a link 174 and a rotary cam 176, is provided for the other swing arm 144.

The two cams 172 and 176 rotate in timed relation with the intermittent feed motion of the erected BIB packages. Thus, when each package reaches the second station II, both swing arms 144 and 150 are pivoted downwardly to lower the pusher 144 and the tab folder blades 158. The lobes of the rotary cams 172 and 176 are so designed that the pusher 140 lags behind the tab folder blades 158 in their downward travel, with the result that the cam 162 acts on the pair of cam follower rolls 160 thereby causing the tab folder blades to move toward each other and hence to fold the side tabs 42 of the bevel flap 30*a* of the package downwardly. Almost concurrently, the pusher 140 descends onto the foldline 38, or thereabouts, between the bevel flap 30*a* and the top flap 30*b*, as shown in FIG. 13. Thus the bevel flap 30*a* is folded down and, together with its folded side tabs 42, caught between the second 8 and third 10 panels. This state is represented in FIG. 10A.

At the same time with such operation of the folder mechanism 136, the other folder mechanism 138 at the second station II acts on the bottom end of the package B. As shown in both FIGS. 7 and 10A, the folder mechanism 138 includes a revolvable kick arm 178 arranged for engagement with the second bottom flap 54 of the package. Upon revolution of the kick arm 178 in the counterclockwise direction, as viewed in FIG. 7, the second bottom flap 54 becomes folded outwardly, in the traveling direction of the package, into right-angular relationship with its second panel 8.

After having been thus processed at the second station II, the package is fed onto the third station III. It will be observed from FIG. 10A in particular that a single guide rail 180 and a pair of vertically spaced guide rails 182 are located on the opposite sides of, and extend along, the conveyor chain 130. Lying on the top side of the packages on the conveyor chain, the single guide rail 180 at one of its ends is disposed immediately forwardly of the second station II and extends in the downstream direction of the conveyor. It is the function of this guide rail 180 to maintain the bevel flap 30*a* folded down, by making relative sliding engagement with the bevel flap and the first top flap 30*b* at the foldline therebetween.

The pair of vertically spaced guide rails 182, lying on the opposite side of the conveyor chain 130 at their starting ends are also disposed immediately forwardly of the second station II. These starting end portions of the guide rails 182 curvedly diverge apart from each other in a vertical plane, increasing in spacing as they extend rearwardly. Thus, as the package travels from the second station II toward the third station III, the first and fourth bottom flaps 52 and 58 become gradually folded inwardly by making sliding contact with the respective guide rails 182. The two opposed bottom flaps 52 and 58 are completely folded and close the bottom end of the box when the package reaches the third station III. Such early infolding of the bottom flaps 52 and 58 is intended to protect the bottom of the bag 4 from possible rupture due to engagement with the guide rails 182. The other opposed pair of bottom flaps 54 and 56, however, to which the bag 4 is attached as in FIG. 1, should not yet be infolded.

The pair of guide rails 182 serves the additional purpose of holding the second bottom flap 54 in right-angular relationship with the second panel 8 as the bottom flap is folded out by the kick arm 178. Furthermore, as the package travels from the second station II toward the third station III, the guide rails 182 function to fold the third bottom flap 56 outwardly into right-angular relationship with the third panel 10.

At the third station III, the opposed pair of second and third top flaps 32 and 34 are infolded to close the top end of the box. Provided for the infolding of the third top flap 34 is a kick arm 184 which revolves in the clockwise direction, as viewed in FIG. 7, in engagement with the third top flap. Such revolution of the kick arm 184 is of course timed relative to the intermittent feed motion of the successive packages on the conveyor chain 130. A pair of vertically spaced guide rails 186, extending forwardly from the third station III, are curved outwardly at their starting ends. As the package arrives at the third station, therefore, its second top flap 32 is infolded by the curved end portions of the guide rails 186.

Figure 15:
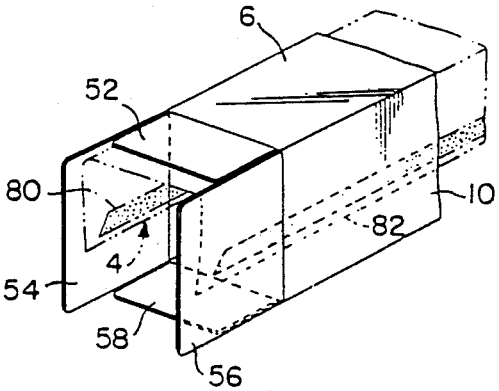
FIG. 15 is a fragmentary perspective view of the semifinished package erected as in FIG. 11, the view being explanatory of the initial state of its bottom end.
Figure 16:
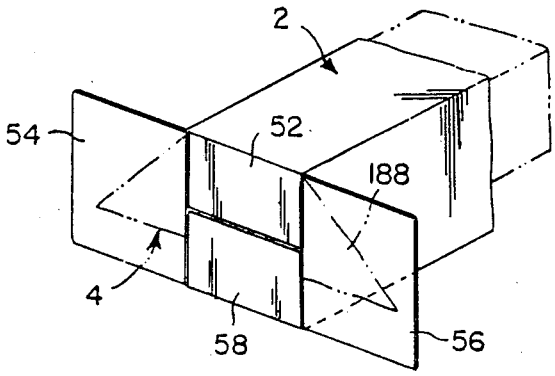
FIG. 16 is a view similar to FIG. 15 except that a pair of opposed bottom flaps of the box are shown infolded, and the other pair of opposed bottom flaps shown folded out, preparatory to the inflation of the bag within the box.

On the bottom side of the package, on the other hand, the pair of guide rails 182 folds out the third bottom flap 56 during the package travel from the second station II to the third station III. Thus, at the third station III, the bottom end of the package is in the state of FIG. 16, with the opposed pair of bottom flaps 52 and 58 infolded to close the package and with the other opposed pair of bottom flaps 54 and 56 folded out into coplanar relationship to each other. FIG. 16 may be compared with FIG. 15, which represents the state of the bottom end of the package at the first station I.

Figure 17:
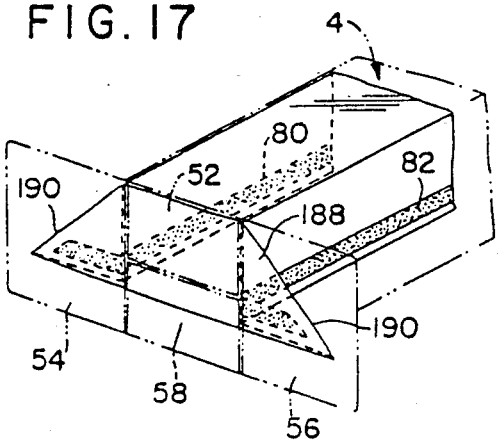
FIG. 17 is a fragmentary perspective view showing the state of the bag when the bottom flaps of the box are folded as in FIG. 16.

The package bottom state of FIG. 16 constitutes one of the most pronounced features of this invention, so that it will be discussed in further detail, with reference directed also to FIG. 17. When all the bottom flaps of the box 2 extend straightly from its panels as in FIG. 15, the bottom end portion of the bag 4 therein takes the shape of an inverted U. As the second and third bottom flaps 54 and 56 are folded out as in FIG. 16, however, the bag 4 has the opposite sides of its bottom end portion folded into triangular shape, as indicated at 188. This is because, as best depicted in FIG. 17, the bag 4 is attached to the bottom flaps 54 and 56 by the adhesive regions 80 and 82 extending along the opposite lateral edges of the bag. These adhering bottom end portions of the bag are folded out together with the bottom flaps 54 and 56, creating the two superposed triangular portions 188 folded along lines 190 extending approximately diagonally of the bottom flaps.

Midway between the third and fourth stations III and IV, and on the package top side of the chain conveyor, there is disposed a nozzle 192 for ejecting a hot-melt adhesive onto the package traveling toward the fourth station. Since the nozzle 192 is fixed, and the package in rectilinear motion, the adhesive adheres in the form of a horizontal strip to the outside surfaces of the second and third top flaps 32 and 34 closing the top end of the package.

At the fourth station IV a kick arm is provided at 194 for kicking the fourth top flap 36 upwardly into face-to-face contact with the previously folded second and third top flaps 32 and 34. The fourth top flap 36 is secured to the top flaps 32 and 34 by means of the adhesive applied to the latter from the nozzle 192. The bottom end of the package is not processed in any way at the fourth station IV and simply passes this station with the second and third bottom flaps 54 and 56 held open by the guide rails 182.

Another nozzle 196 is disposed midway between the fourth and fifth stations IV and V and on the package top side of the chain conveyor. This nozzle applies a jet of hot-melt adhesive onto the exposed surface of the infolded fourth top flap 36.

The fifth station V also has a revolvable kick arm at 198 for folding the first top flap **30*b*, which has been angled upwardly during the package travel from the second station II to the fifth station V, down onto the previously infolded fourth top flap 36. The adhesive applied to the fourth top flap 36 from the nozzle 196 retains the first top flap 30*b* thereon. Thus is the top end of the package completely closed with the flaps 30, 32, 34 and 36. A pair of vertically spaced guide rails 204 extend from the fifth station V to the last station X in order to assure the firm adhesion of the infolded top flaps to one another. The bottom end of the package is not processed at the fifth station V, either, and the second and third bottom flaps 54 and 56 are still held open by the guide rails 182**.

Figure 18:
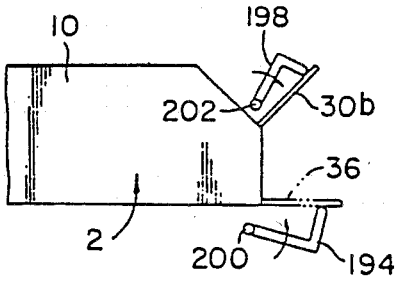
FIG. 18 is a view explanatory of the operation of kick arms for infolding a pair of opposed top flaps of the box in the apparatus of FIGS. 7 and 8.

FIG. 18 illustrates in more detail the aforesaid kick arms 194 and 198 for infolding the fourth and first top flaps 36 and **30*b* respectively. These kick arms revolve about horizontal axes 200 and 202**.

Figure 10B:
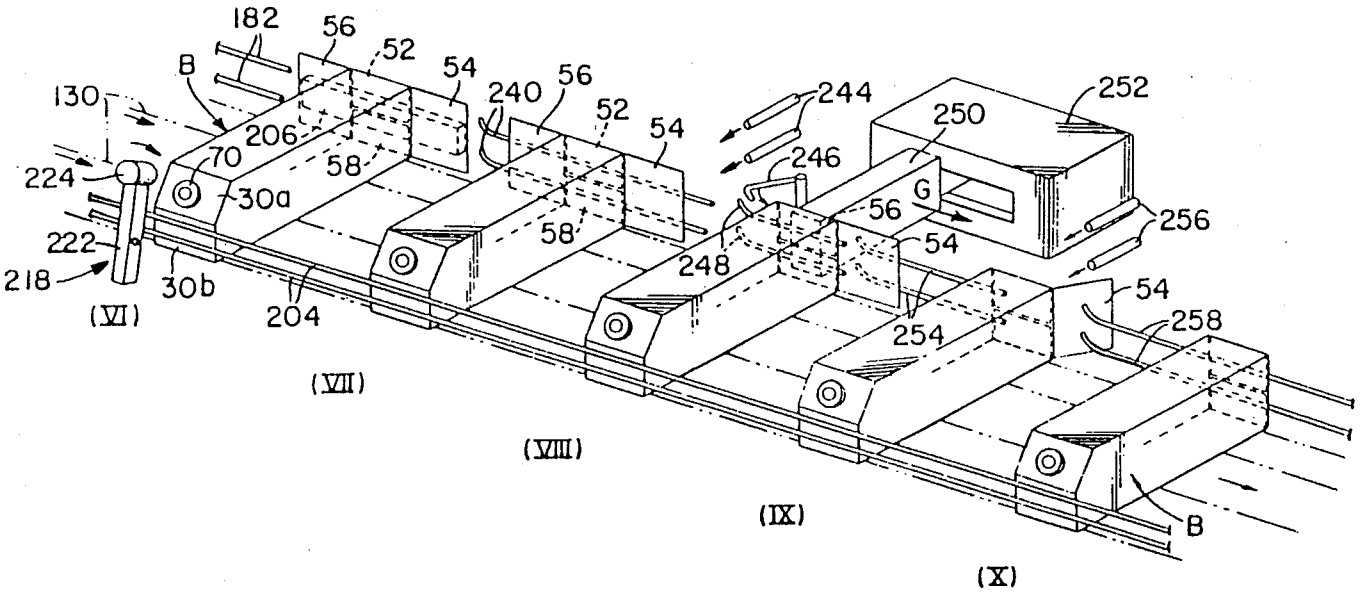
FIG. 10B is a perspective view explanatory principally of the operations to be performed on the semifinished packages in the second half of the apparatus of FIGS. 7 and 8.

FIG. 10B best illustrates the subsequent stations VI through X. The sixth station VI is intended for the inflation of the bag 4 within the box 2, by introducing pressurized air or other gas, which may be heated or otherwise sterilized, into the bag through its fitment 70. For such inflation of the bag it is essential, or preferable at least, that the bottom end of the package be held against a flat, resiliently yieldable surface during the introduction of pressurized air or the like into the bag. In the illustrated embodiment of the invention, the flat, resiliently yieldable surface takes the form of an abutment 206 arranged for direct contact with the bottom end of the package. The pair of guide rails 182 terminate short of the sixth station VI to permit such direct contact of the abutment 206 with the package.

Figure 19:
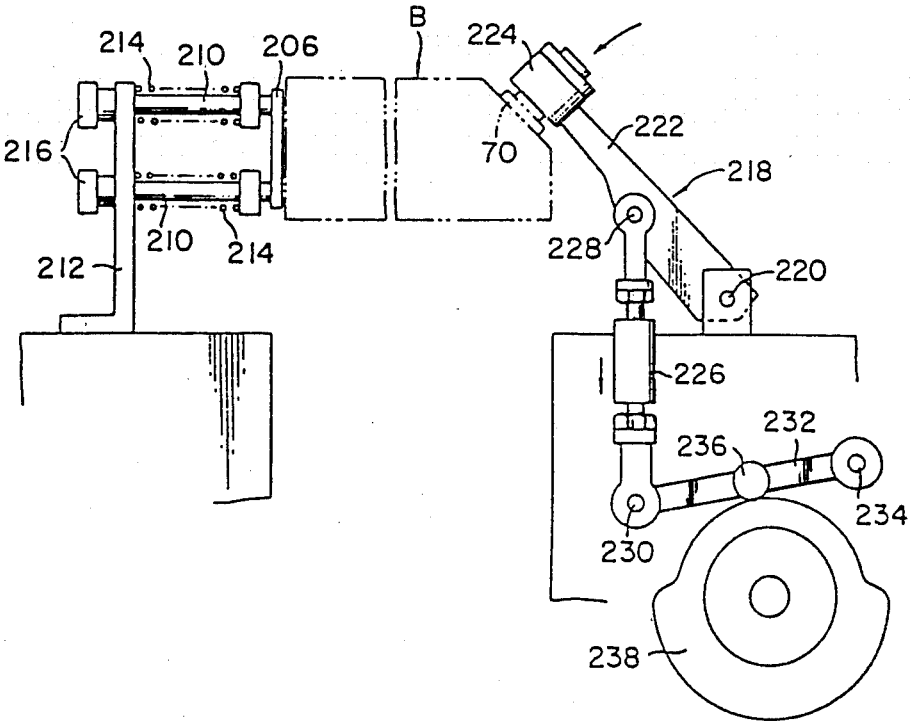
FIG. 19 is an enlarged elevational view, as seen from the upstream side in the apparatus of FIGS. 7 and 8, of means for inflating the bag of the semifinished package and of means for yieldably supporting the bottom end of the package during the inflation of the bag.

As will be seen from both FIGS. 10B and 19, the abutment 206 has a sufficient size to cover the bottom end of the package inclusive of its folded-out bottom flaps 54 and 56. The abutment 206 has rods 210 extending rearwardly therefrom and slidably extending through an upstanding support 212 to terminate in enlargements 216 acting as stops. A compression spring 214 is sleeved upon each rod 210 to bias the abutment 206 toward the right as viewed in FIG. 19, to an extent limited by the stops 216 on the rods 210. When pressed by the package, therefore, the abutment 206 yieldably withstands the pressure by the force of the compression springs 214.

FIG. 19 also illustrates in detail an inflating mechanism 218 disposed on the package top side of the chain conveyor at the sixth station VI. The inflating mechanism includes a blow head 224 on one end of a swing arm 222, the other end of which is pivoted at 220 on a suitable mount to permit the swinging motion of the arm in a vertical plane. A link 226 at one of its ends is pin-jointed at 228 to the swing arm 222 and at the other end likewise pin-jointed at 230 to a lever 232. Mounted for pivotal motion about a fixed horizontal axis at 234, the lever 232 has a cam follower roll 236 rotatably mounted thereon intermediate its ends. The cam follower roll 236 is sprung into engagement with a rotary cam 238. It is thus seen that the swing arm 222 oscillates up and down with the rotation of the cam 238.

When the package B reaches the sixth station VI, therefore, the swing arm 222 is turned in the counterclockwise direction, as viewed in FIG. 19, thereby bringing the blow head 224 into engagement with the fitment 70 of the bag 4 projecting outwardly of the bevel flap 30*a*. As the blow head 224 ejects compressed air or the like, the bag will be inflated, almost in an instant, into close internal contact with the box 2. Although the bottom end of the package is not yet completely closed, the abutment 206 yieldably closes the bottom end to prevent the bag 4 from bulging out while being inflated.

Were it not for the yieldably supported abutment 206, the bottom end portions 188 of the bag 4 would bulge out in a disorderly manner, even though they have been neatly folded into triangular shape as in FIGS. 16 and 17. Such bulging-out of the bottom end portions 188 might also exert undue stresses on the bottom flaps 54 and 56 of the box 2, possibly breaking the flaps. The yieldable abutment 206 obviates all these unfavorable results. Although the inflated bag may more or less displace the abutment rearwardly against the effect of the compression springs 214, that one of the superposed layers of the bag which is attached to the bottom flaps 54 and 56 will retain the triangular shape of its folded portions 188. The charged air will fill up the interior of the bag, urging the same into snug contact with the complete inside surfaces of the box including the closed bottom flaps 52 and 58.

The package B with the inflated bag 4 therein is then carried to the seventh station VII. The second and third bottom flaps 54 and 56 are still held folded out at this station. The top end of the package is not processed at this and all the following stations.

Slightly downstream of the seventh station VII there are mounted a pair of vertically spaced nozzles 244 for applying jets of hot-melt adhesive onto the exposed surfaces of the infolded first and fourth bottom flaps 52 and 58. The application of the adhesive to these bottom flaps is not an essential requirement, however, as will become apparent as the description proceeds.

At the eighth station VIII a kick arm 246 is disposed on the package bottom side of the chain conveyor infolding the third bottom flap 56 of the package over the adhesive-applied surfaces of the first and fourth bottom flaps 52 and 58. The eighth station has a pair of vertically spaced guide rails 248 for pressing the infolded third bottom flap 56 against the flaps 52 and 58. The guide rail pair 248 is made retractable in the downstream direction of the chain conveyor during the infolding of the third bottom flap 56 by being affixed to a support arm 250. This support arm itself is coupled to a suitable drive mechanism 252 for linear movement in the direction of the arrow G. The third bottom flap 56 is infolded while the guide rail pair 248 is retracted in the downstream position by the support arm 250. Upon completion of the infolding of the third bottom flap, the guide rail pair 248 returns to its illustrated upstream position to hold the bottom flap against the first and fourth bottom flaps 52 and 58 for firm adhesion thereto.

Another pair of guide rails 254 extend from the eighth station VIII to the ninth station IX, holding the second bottom flap 54 of the package folded out. The ninth station has a pair of nozzles 256 for applying an adhesive onto the outer surface of the previously infolded third bottom flap 56.

A final pair of guide rails 258 at their starting ends are located immediately downstream of the ninth station IX and extend past the tenth station X. The guide rail pair 258 acts on the remaining second bottom flap 54 to fold the same inwardly as the package travels from the ninth to tenth station. The second bottom flap 54 is completely infolded and attached to the third bottom flap 56 by means of the adhesive as the package reaches the last station X. The fabrication of the BIB package B is now completed.

With reference back to FIG. 8 an unloading actuator 260 lies under the tenth station X for pushing up and unloading the successive finished packages from the cradles 124. Thus raised, each package is then pressed by a transfer mechanism 262 onto another standby rack 264 to be held standing by thereon prior to delivery into a filling system.

Figure 20:
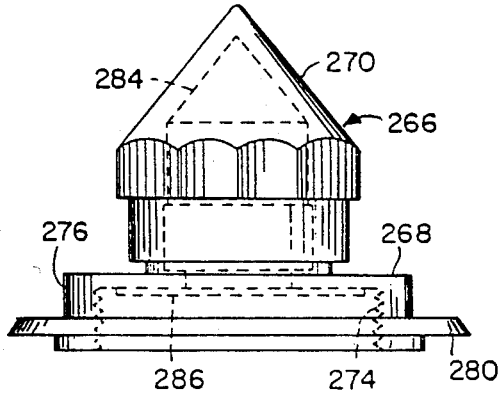
FIG. 20 is an elevational view of an example of dispenser mechanism to be attached to the fitment of FIG. 3.
Figure 21:
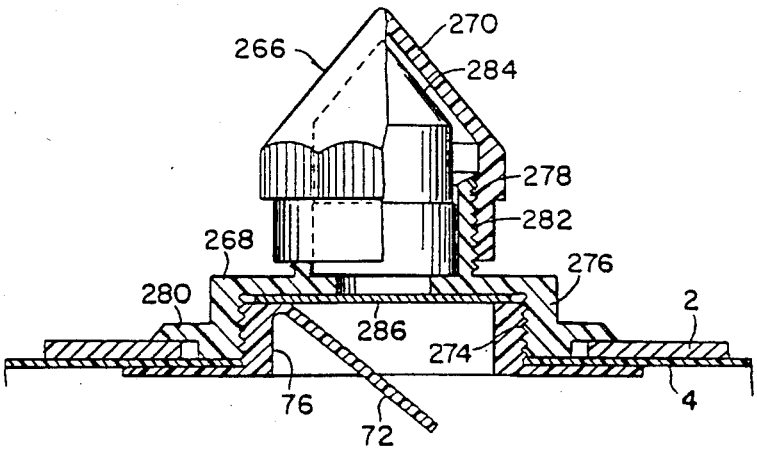
FIG. 21 is a sectional view, partly in elevation, of the dispenser mechanism of FIG. 20 as attached to the fitment of FIG. 3.

FIGS. 20 and 21 illustrate an example of a dispenser mechanism 266 to be attached to the fitment 70 of each BIB package after the filling of a beverage or any other desired commodity. The exemplified dispenser mechanism 266 comprises a spout 268 and a cap 270, both of plastics material. The spout 268 is shown as a stepped tubular member, including a large diameter portion 276 internally threaded at 274 for engagement with the external thread 272 (FIG. 3) of the fitment 70, and a small diameter portion 278 extending upwardly from the large diameter portion. The spout portion 276 may not necessarily make threaded engagement with the fitment 70 but may be pressfitted over, or otherwise firmly engaged with, the fitment. The spout portion 276 is flanged at 280, and the other spout portion 278 is externally threaded at 282 for engagement with the internally threaded portion of the cap 270.

A seal 286, normally in the form of metal foil, is fitted between the two constituent portions 276 and 278 of the spout 268 for closing the fitment 70. For opening the seal 286, an opener member 284 having a pointed end is accommodated in a closed space bounded by the cap 270 and the spout portion 278.

Assembled as pictured in FIG. 20, the dispenser mechanism 266 is mounted in position on the filled BIB package, its spout portion 276 being threadedly or otherwise securely engaged with the fitment 70. The flange 280 on the spout portion 276 engages the encircling edges of the box 2 and bag 4 between itself and the flange 74 on the fitment 70.

For the dispensation of the product from within the BIB package, the consumer first unscrews the cap 270 from the spout 268. He or she then takes out the opener member 284 and, with its pointed tip, punctures the seal 286. The product can now be poured out of the package through the fitment 70 and the spout 268, the end seal 72 of the fitment having been punched open during the fabrication of the package, as in FIG. 3.

Figure 22:
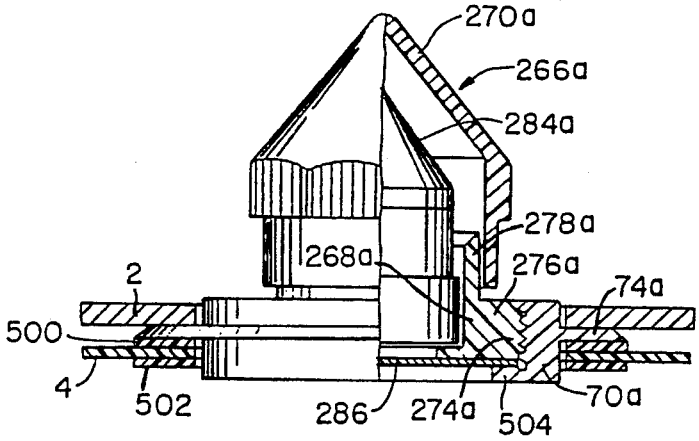
FIG. 22 is a sectional view, partly in elevation, of a modified dispenser mechanism as attached to a correspondingly modified fitment on the bag.

FIG. 22 shows another example of dispenser mechanism 266*a* together with a modified fitment 70*a*. The bag 4 for use with the modified fitment and dispenser mechanism is made, for example, of laminar film consisting of oriented polypropylene, vinylidene-coated, oriented nylon, and polyethylene.

Considering first the fitment 70*a*, it will be noted that it has a flange 74*a* formed intermediate between its ends. The flange 74*a* is fused onto the outside surface of the bag 4 via an annular coupling member 500. The coupling member 500, which is preferably a polypropylene casting, is to be employed if the outermost layer of the bag 4 has poor fusibility. This member may therefore be omitted if the fitment flange 74*a* is directly fusible onto the outside surface of the bag. Another similar member 502 secured to the inside surface of the bag 4 in register with the coupling member 500 is of two layers, one made of the same substance as the inmost layer of the bag or of a material readily fusible thereto, and the other made of a substance infusible thereto. In the illustrated embodiment of the invention the two layers of the member 502 are of polyester and polyethylene. This member serves the purpose of preventing the thermal fusion of the two opposed layers or walls of the bag to each other during the attachment of the fitment 70*a* thereto.

The fitment 70*a* is internally threaded at 274*a*. A rim 504 is formed at the inner end of the fitment.

The modified dispenser mechanism 266*a* comprises a spout 268*a* and a cap 270*a*. The spout 268*a* at its large diameter portion 276*a* is screwed into the fitment 70*a* and at its bottom abuts against the fitment rim 504 via the seal 286. The small diameter portion 278*a* of the spout is removably engaged with the cap 270*a* in any suitable manner. The cap 270*a*, and the opener member 284*a* housed in the dispenser mechanism, can be essentially identical with those described in connection with FIGS. 20 and 21.

The fitment-dispenser combinations of FIGS. 20 and 21 and of FIG. 22 both feature the fact that the dispenser mechanisms 266 and 266*a* can be attached to the fitments 70 and 70*a*, respectively, after the filling of the BIB package. Such delayed attachment of the dispenser mechanisms to the fitments is preferred because of the smaller space requirement of the packages until they are filled.

Figure 23:
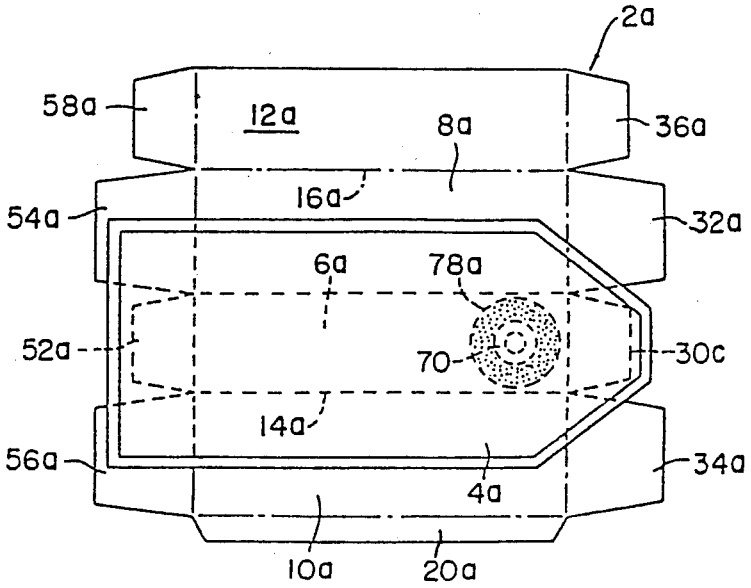
FIG. 23 is a view corresponding to FIG. 1 but showing a modified combination of box and bag to be fabricated into the BIB package according to the invention.

FIG. 23 gives another preferable form of the BIB package according to the invention, shown in a state corresponding to FIG. 1. The modified package also comprises a box 2*a* and a bag 4*a*. The box 2*a* differs from the box 2 of FIG. 1 in having no bevel flap but only a top flap 30*c*, foldably connected directly to the first panel 6*a*. This box is therefore to be fabricated into exactly rectangular shape. The hole for permitting the outward projection of the fitment 70 or 70*a* on the bag 4*a* is formed in the first panel 6*a*. The bag 4*a* is similar to the bag 4 of FIG. 2 except that the triangular corner portions of the former, bounded by the diagonal sealing lines indicated at 60 in FIG. 2, are cut off.

Another feature of the box-and-bag assembly of FIG. 22 is that the bag 4*a* is affixed to the box 2*a* only at an annular adhesive region 78*a* surrounding the fitment 70 or 70*a*, that is, only to the inside surface of the first panel 6*a*. It is of course possible, however, to adhere the bag 4*a* to the box 2*a* in a manner disclosed in FIG. 1.

Figure 24A:
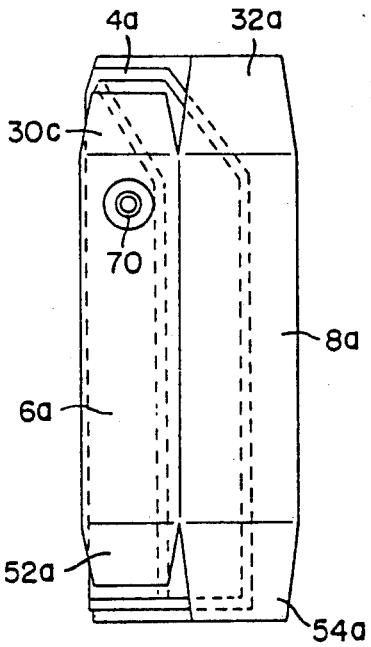
Figure 24B:
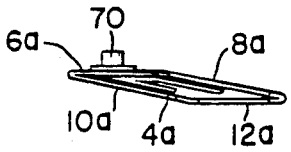

Illustrated in FIGS. 24A and 24B through FIGS. 29A through 29B is a preferred sequence of processing the box-and-bag assembly of FIG. 23 into the BIB package in accordance with the invention. In FIGS. 24A and 24B the box-and-bag assembly is shown in a semifinished, collapsed state corresponding to FIGS. 5 and 6, with the junction tab 20*a* (not seen) of the box adhered to the fourth panel 12*a*. It is understood that the box-and-bag assembly has been folded along the foldline 14*a* between the first and third panels 6*a* and 10*a* and along the foldline 16*a* between the second and fourth panels 8*a* and 12*a*. The four top flaps 30*c*, 32*a*, 34*a* and 36*a* and the four bottom flaps 52*a*, 54*a*, 56*a* and 58*a* are left unfolded.

Figure 25A:
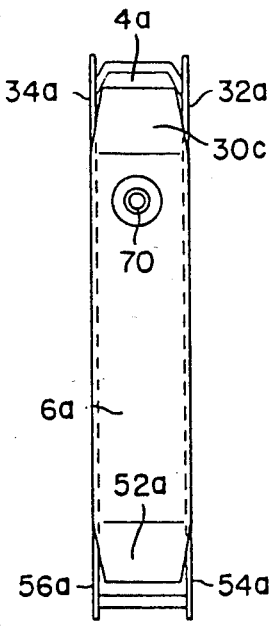
Figure 25B:
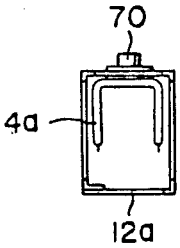

FIGS. 25A and 25B show the semifinished package subsequently erected and standing on the fourth panel 12*a*, as at the first station I in the apparatus of FIGS. 7 through 10. The bag 4*a* now assumes the shape of an inverted U within the box.

Figure 26A:
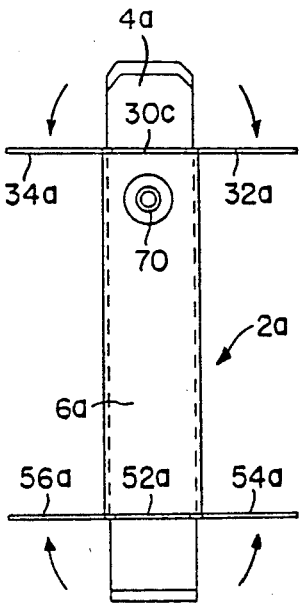
Figure 26B:
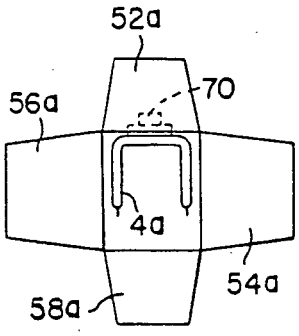

All of the top flaps 30*c*, 32*a*, 34*a* and 36*a* and bottom flaps 52*a*, 54*a*, 56*a* and 58*a* of the box 2*a* are folded out in FIGS. 26A and 26B. The opposite ends of the bag 4*a* project out of the box 2*a*.

Figure 27A:
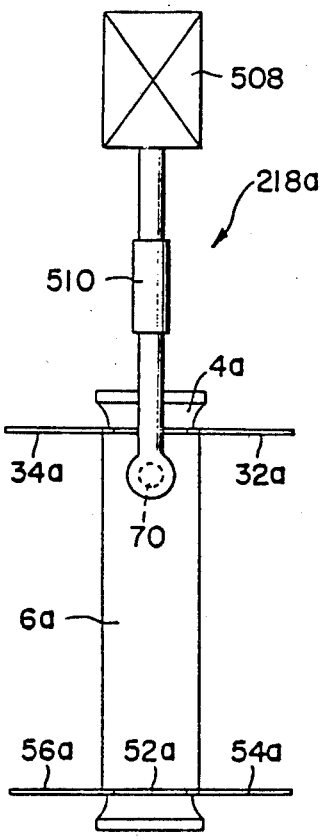
Figure 27B:
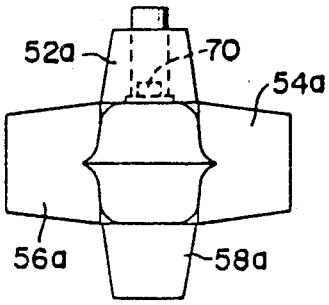

Then, as at the sixth station VI of the previously disclosed apparatus, germfree air or other gas under pressure is introduced into the bag 4*a* through its fitment 70 or 70*a* for inflating the bag into close contact with the inside surfaces of the box as in FIGS. 27A and 27B. These figures also show an inflating mechanism 218*a* comprising a compressor 508 and a bacteriological filter 510.

Figure 28A:
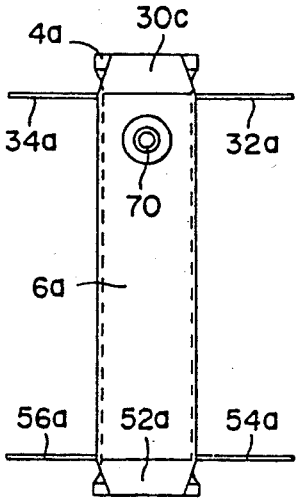
Figure 29A:
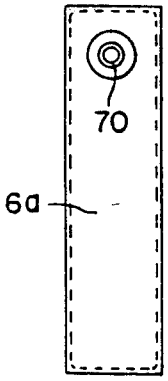
Figure 28B:
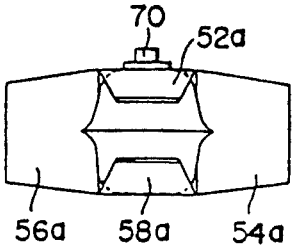
Figure 29B:
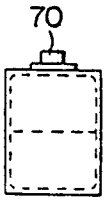

FIGS. 28A and 28B show the first and fourth top flaps 30*c* and 36*a* and bottom flaps 52*a* and 58*a* of the box infolded following the inflation of the bag. Then, after applying an adhesive to the outside surfaces of these infolded top and bottom flaps, the remaining top flaps 32*a* and 34*a* and bottom flaps 54*a* and 56*a* of the box are infolded to completely close the opposite ends thereof. FIGS. 29A and 29B represent the thus-fabricated BIB package. The dispenser mechanism 266 of FIGS. 20 and 21 or 266*a* of FIG. 22 is to be attached to the fitment 70 or 70*a*, and the fitment is to be fluid-tightly closed as by the induction heating of the seal 286 of FIGS. 21 and 22, after the filling of the BIB package.

Figures 30A, 30B, 30C, 30D:
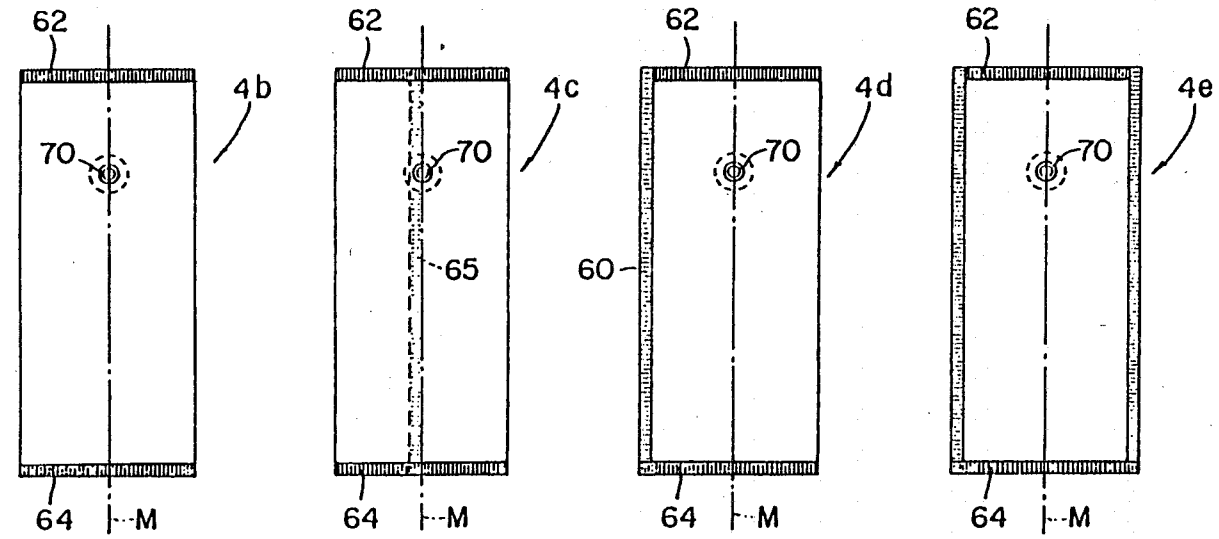
FIGS. 30A through 30D are elevational views of additional examples of bags suitable for use in the BIB package of this invention.

In FIGS. 30A through 30D there are illustrated additional examples of bags that can be incorporated in the BIB package according to the invention. The bag 4*b* of FIG. 30A is made of a tubular sheet or film of plastics or like flexible material, heat-sealed along its top and bottom edges 62 and 64 and flattened to provide the two superposed layers of the sheet or film.

The bags 4*c* and 4*d* of FIGS. 30B and 30C are both fabricated from a single rectangular sheet or film of flexible material. For the formation of the bag 4*c* the rectangular sheet is folded along two parallel lines and heat-sealed along the top and bottom edges 62 and 64 and along the opposed longitudinal edges 65 lying approximately midway between the two parallel foldlines. The bag 4*d*, on the other hand, is formed by folding the rectangular sheet in two and heat-sealing the same along the top and bottom edges 62 and 64 and along one of the longitudinal side edges 60. The bag 4*e* of FIG. 30D is analogous with the bag 4 of FIG. 2 except that the former has no diagonal sealing lines 68 or keyhole-shaped recesses 68.

It will also be noted from FIGS. 30A through 30D that the fitment 70 or 70*a* is attached to one of the superposed layers or sheets of the bag 4*b*, 4*c*, 4*d* or 4*e* in the vicinity of its top edge 62 and on a medium line M extending longitudinally of the bag. The same holds true with the bag 4 of FIG. 2 and the bag 4*a* of FIG. 23.

Described hereinbelow is the apparatus for, and the method of, filling a beverage or other fluid food or nonfood product into the BIB package, fabricated as at the station X in FIG. 10B, and then capping the package with the dispenser mechanism of FIGS. 20 and 21 or FIG. 22.

Figure 31:
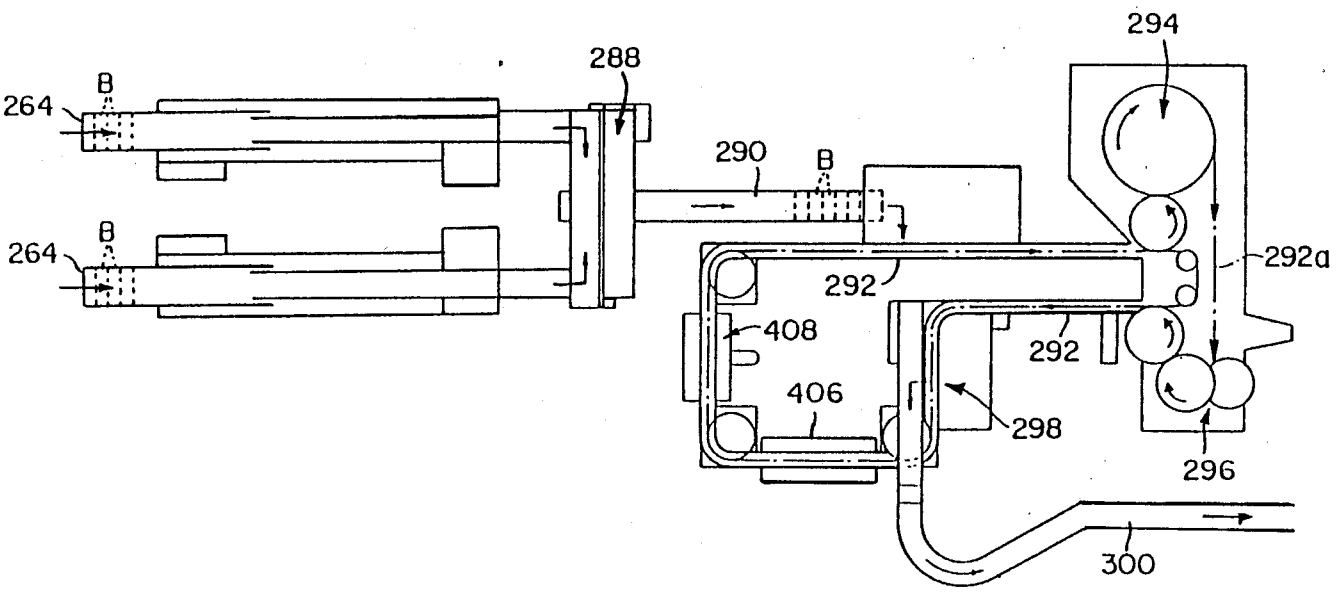
FIG. 31 is a schematic top plan view of apparatus, to be installed next to the apparatus of FIGS. 7 and 8, for filling and capping the completed BIB packages.

FIG. 31 is explanatory of the general organization of the filling and capping apparatus. Seen at the left in this figure are a pair of standby racks 264, one of which is shown at the right hand end in FIGS. 7 and 8. The fabrication of the successive BIB packages proceeds at a lower rate than they are filled and capped by this apparatus. So, normally, two fabrication lines are used in juxtaposition for simultaneous delivery of the completed packages B onto the two parallel standby racks 264. These racks lead to a merging station 288, where the two rows of packages are combined and sent out onto an infeed conveyor 290 in a single file, with each package oriented transversely of the conveyor.

From the infeed conveyor 290, the packages B are transferred onto a closed path 292 and, loaded one on each carrier yet to be described, are fed therealong in the arrow-marked direction. Thus traveling along the path 292, the packages are filled by a filling mechanism 294, capped by a capping mechanism 296, and then dislodged from the carriers by an unloading mechanism 298. The dislodged packages are fed along another path 300 to a desired destination, as for shipment or storage.

Figure 32:
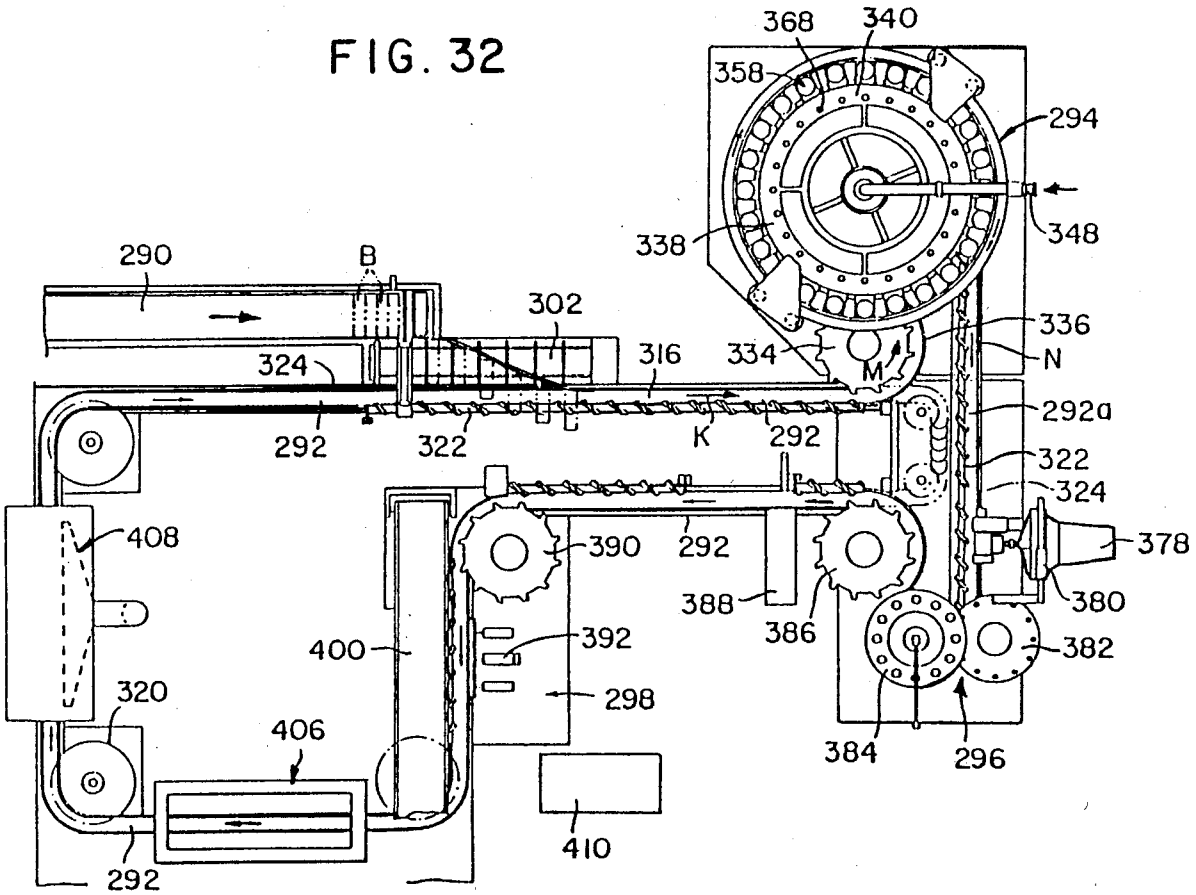
FIG. 32 is an enlarged top plan view showing some essential parts of the apparatus of FIG. 31 in greater detail.

FIG. 32 illustrates in further detail the infeed conveyor 290, the closed path 292, and the means associated therewith. Seen at 302 is a loading conveyor of comparatively short extent interposed between, and extending parallel to, the exit end portion of the infeed conveyor 290 and the adjoining part of the path 292. The loading conveyor 302 functions to transfer the packages B onto the path 292, by loading them on the noted carriers. As shown in still more detail in FIG. 33, the loading conveyor 302 is an endless one, with its upper flight running in the direction of the arrow J. A series of constantly spaced ridges 304 are formed transversely on the loading conveyor 302 for positive engagement with the packages.

At the exit end of the infeed conveyor 290 there is provided a pull member 306 which is secured to the piston rod 310 of a fluid actuated cylinder 308 fixedly mounted over the loading conveyor 302. Upon contraction of the cylinder 308, therefore, the pull member 306 travels across the exit end of the infeed conveyor 290 thereby transferring each foremost one of the packages thereon onto the loading conveyor 302. The infeed conveyor 290 has a retainer mechanism 312 for frictionally retaining the package next to the foremost one, so that all of the succeeding packages are held by standing by on the infeed conveyor during the transfer of each foremost package onto the loading conveyor 302.

Figure 33:
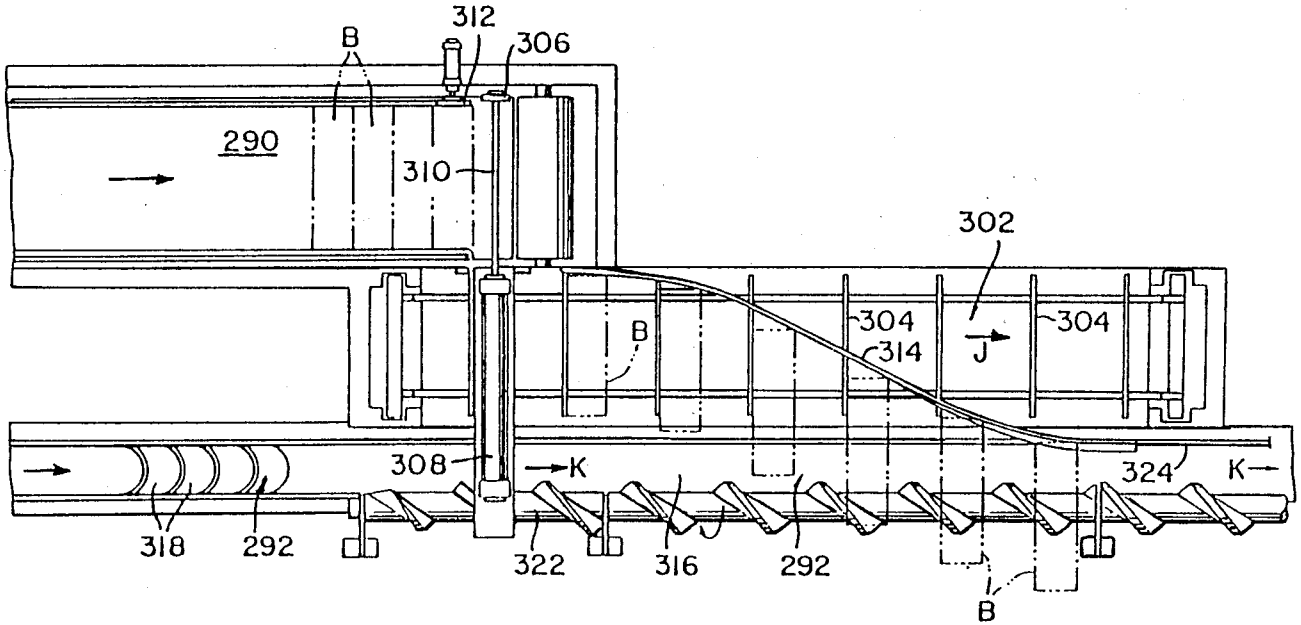
FIG. 33 is a still further enlarged top plan view of the infeed conveyor, loading conveyor, crescent conveyor, and some other parts closely associated therewith, in the apparatus of FIG. 31.

FIG. 33 also clearly reveals a guide 314 arranged diagonally over the loading conveyor 302, curvilinearly crossing the conveyor from its infeed conveyor side to the opposite side as the guide extends in the downstream direction. Consequently, as the packages travel on the loading conveyor 302 in positive engagement with its transverse ridges 304 and in sliding contact with the guide 314, they gradually shift sideways until they become completely transferred onto the path 292 at the downstream extremity of the guide, as demonstrated by the series of phantom packages in FIG. 33.

With reference directed further to FIG. 33 the feed path 292 of the packages has a horizontal load-bearing surface 316 which is formed by a series of articulated crescents 318 in the illustrated embodiment. Forming a closed loop as best seen in FIG. 32, the series of crescents provides a conveyor driven in the direction of the arrows K by a conventional drive mechanism 320.

Disposed on one side of the crescent conveyor 319 and extending therealong is a helically bladed feed screw 322 which is driven in the direction indicated by the arrow in FIG. 33. The function of this feed screw will be explained later on. A guide rail 324 is disposed on the opposite side of the crescent conveyor 319 and also extends therealong.

Figure 34:
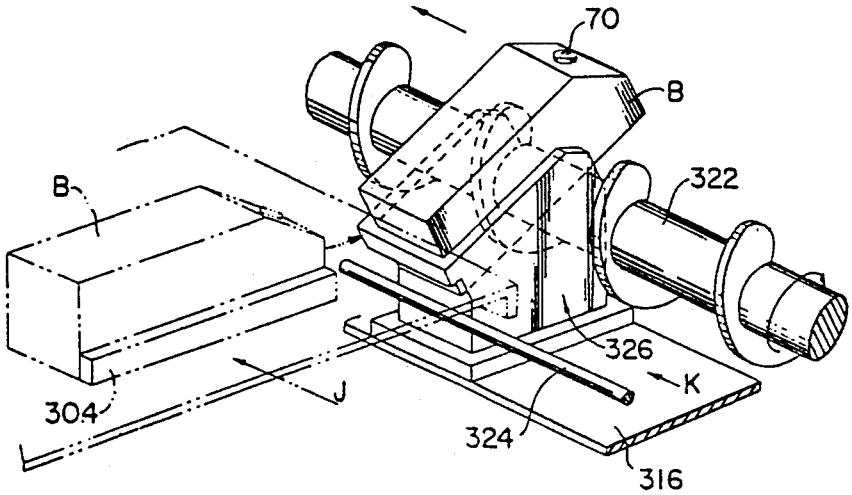
FIG. 34 is an enlarged, fragmentary perspective view showing one BIB package loaded on the package carrier traveling along the predetermined feed path in the apparatus of FIG. 31.
Figure 35:
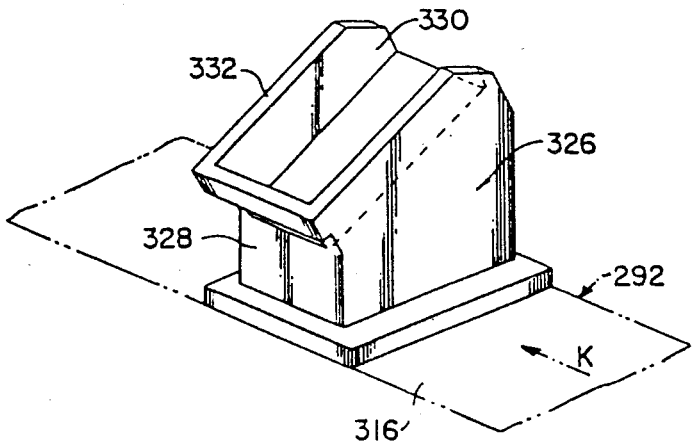
FIG. 35 is a perspective view of the package carrier.

FIG. 34 illustrates one of the noted package carriers 326 mounted in a row on the crescent conveyor 319 and each slidably caught between the feed screw 322 and the guide rail 324. As shown by itself in FIG. 35, each package carrier 326 comprises a pedestaled standard 328 to be placed directly on the load-bearing surface 316 of the crescent conveyor 319 and a set of walls 332 formed atop the standard to provide an upwardly and laterally open seat 330 for each package. The seat 330 is shown slanted for use with packages of the type having the fitment projecting from the bevel flap. The package carrier 326 can be an integral molding of plastics material.

Mounted on the crescent conveyor 319 as in FIG. 34, the package carrier 326 at one of its ends is in sliding contact with the guide rail 324 and at the other end is slidably engaged between the adjoining blade convolutions of the feed screw 322. Thus, as the feed screw 322 rotates in the arrow marked direction and at a speed determined in relation to the traveling speed of the crescent conveyor 319, the row of package carriers 326 move along the feed path 292 in positive engagement with the feed screw. The package carriers are fed primarily by the crescent conveyor, and the feed screw serves the purpose of maintaining them at the desired constant spacings from one another during their travel along the feed path.

Each BIB package B, traveling on the loading conveyor 302 in sliding contact with the guide 314 as in FIG. 33, rides onto one of the package carriers 326 on the crescent conveyor 319 toward the downstream end of the guide, as will be seen also from FIG. 34. Finally the package becomes snugly seated on the carrier, like the one indicated by the solid lines in FIG. 34. For thus loading the successive packages on the carriers the loading conveyor 302 must of course travel at the same speed as the crescent conveyor 319, the linear motion of the blade convolutions of the feed screw 322 being timed to the movement of the crescent conveyor.

As has been stated, the packages are seated obliquely one on each carrier. Such being the construction of the particular packages B, however, the fitment 70 of each is oriented upwardly as it projects from the bevel flap 30*a*.

In coaction with the feed screw 322 the crescent conveyor 319 feeds the successive packages on the carriers 326 toward the filling mechanism seen at 294 in FIG. 32. Interposed between the crescent conveyor 319 and the filling mechanism 294 are a star wheel or spider 334, revolving in the direction of the arrow M, and an arcuate guide 336 concentric with the star wheel. The revolving star wheel 334 engages the carriers 326 between its neighboring spokes and directs them into the filling mechanism 294 in sliding contact with the arcuate guide 336.

Figure 36:
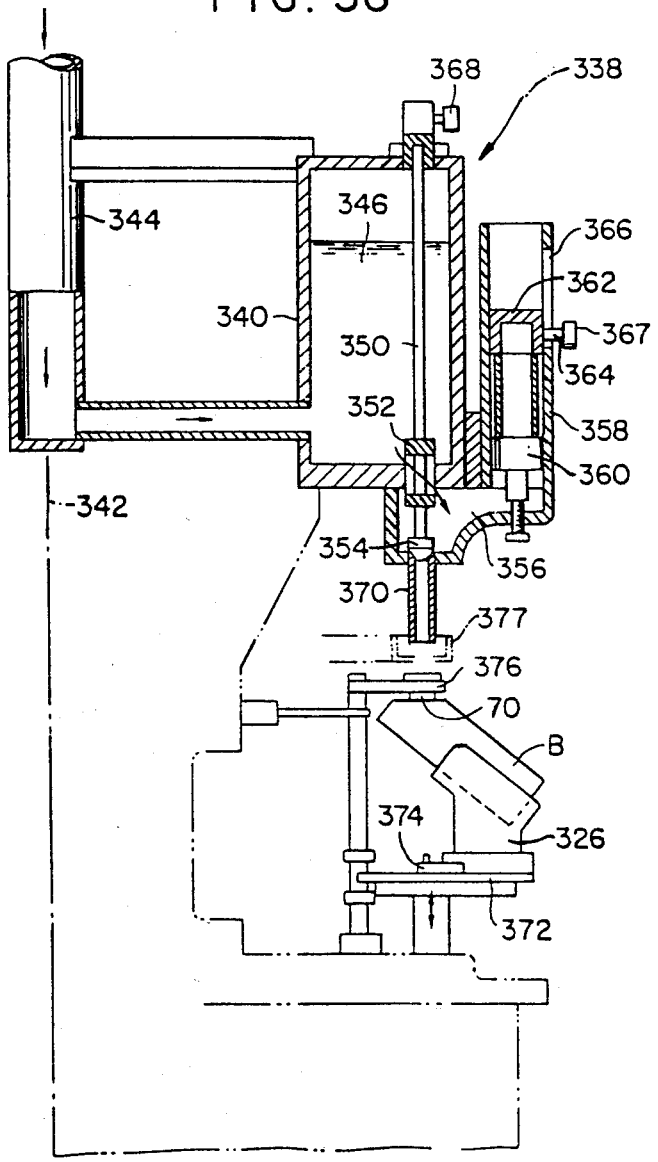
FIG. 36 is an enlarged, partial, vertical sectional view of the filling mechanism in the apparatus of FIG. 31.

The filling mechanism 294 can per se be of largely conventional make, being available as a filling machine shown in an enlarged vertical section in FIG. 36. Its construction and operation will therefore be explained briefly. Seen at 340 in both FIGS. 32 and 36 is an annular tank which contains, for example, a beverage at 346 to be filled into the packages, and which is supported for rotation about a vertical axis 342. The tank 340 receives the beverage from a supply conduit 344 extending along the axis 342, and the supply conduit receives, in turn, the liquid from a radial overhead conduit 348.

A plurality of valve members 352 and 354 are provided at constant spacings at the bottom of the beverage tank 340, with each associated pair of valve members 352 and 354 mounted on a stem 350 extending upwardly therefrom. In the positions represented in FIG. 26, the upper valve member 352 permits the beverage to flow by gravity from the tank 340 into a chamber 356 thereunder, whereas the lower valve member 354 closes a filling spout 370 extending downwardly from the chamber.

In communication with the chamber 356 is an upstanding cylinder 358 having a piston 360 and a slider 362 slidably mounted therein, with the piston and slider being rigidly interconnected. The slider 362 has a pin 364 projecting outwardly of the cylinder 358 through a longitudinal guide slot 366 therein and terminating in a cam follower roll 366. Thus the piston 360 is slidable upwardly of the cylinder 358 from its illustrated lowermost position until the pin 364 on the slider 362 reaches the upper extremity of the guide slot 366.

During the roation of the beverage tank 340 about the axis 342, the cam follower roll 366 is in engagement with a cam, not shown, and is thereby raised to cause upward displacement of the piston 360 in the cylinder 358. A prescribed volume of the beverage is drawn into the cylinder 358 upon full upward displacement of the piston 360 therein. A cam not shown subsequently causes the descent of the piston 360 via the cam follower roll 366. At the same time with the descent of the piston 360, another cam, also not shown, acts on the cam follower roll 368 on the top end of the valve stem 350, causing the same to lift the valve members 352 and 354. Since then the upper valve member 352 discommunicates the chamber 356 from the beverage tank 340, and the lower valve member 354 opens the filling spout 370, the descending piston 360 forces the prescribed volume of beverage out of the filling spout and into the underlying BIB package B through its fitment 70.

Fed into the filling machine now under consideration by the star wheel 334 of FIG. 32, each package carrier 326 rides on a table 372 and is held in position thereon by a retainer 374. The table 372 not only revolves about the axis 342 together with the beverage tank 340 but also moves up and down, lifting the package on the carrier 326 during the dispensation of the beverage from the filling spout 370. A holder 376 holds the fitment 70 of the package. Seen at 377 is a trough for collecting the beverage that may drip from the filling spout 370 when the latter is closed.

The succession of packages that have been filled as described above in the filling mechanism 294 while making nearly one complete revolution therein are fed out, together with their carriers 326, onto a rectilinear feed path 292*a* and travel thereon in the direction of the arrow N in FIG. 32. This feed path is essentially identical in construction with the closed feed path 292, equipped with a guide rail 324 and a feed screw 322 on its opposite sides. The feed path 292*a* extends from the filling mechanism 294 to the capping mechanism 296 shown in FIG. 32.

Also basically of conventional design, the capping mechanism 296 comprises a hopper 378 for supplying dispenser mechanisms to be attached to the fitments of the packages, an aligner 380 for arranging the dispenser mechanisms into a row, a turntable 382 for feeding the row of dispenser mechanisms, and a capper 384 for capping the package fitments with the dispenser mechanisms. Another star wheel or spider 386 feeds the capped packages on the carriers 326 from the capping mechanism 296 back onto the closed feed path 292.

At 388 there are provided means for detecting and withdrawing defective packages from the feed path 292. Passing the means 388, the properly filled and capped packages on the carriers further travel forwardly along the path 292 and, after making a directional change with the aid of an additional star wheel 390, enter the unloading mechanism 298.

Figure 37:
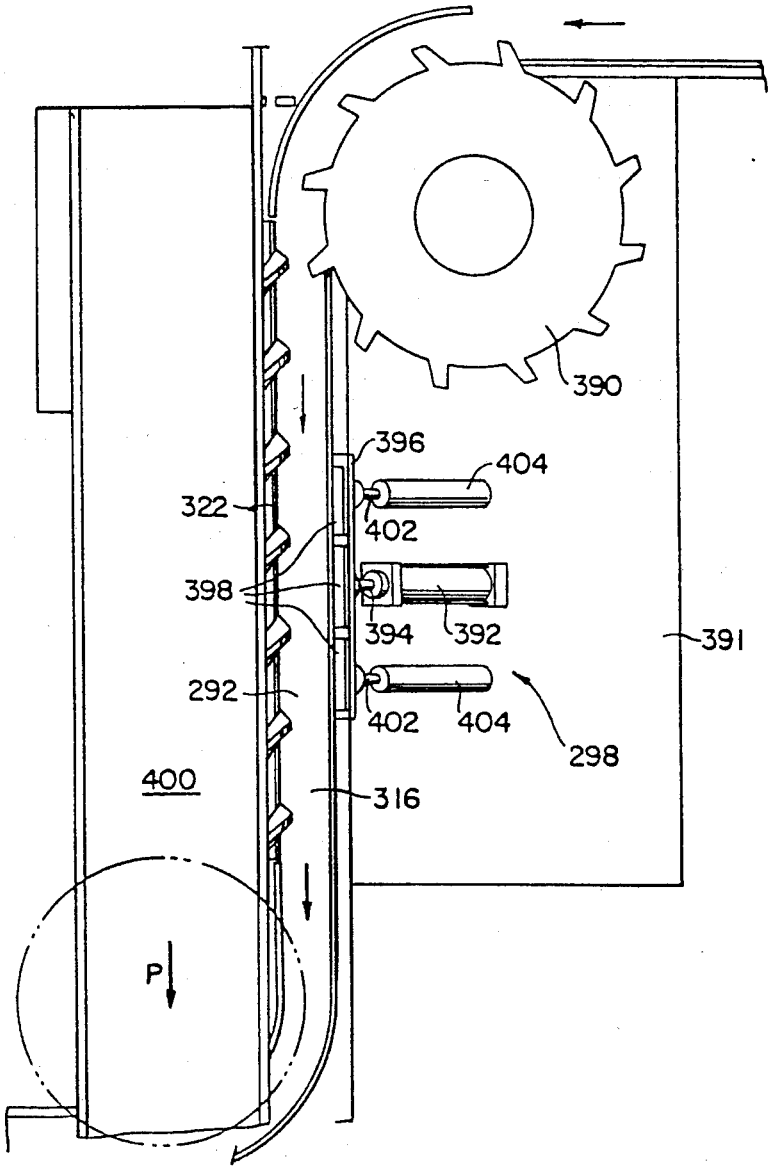
FIG. 37 is an enlarged, top plan view of the unloading mechanism in the apparatus of FIG. 31.

As illustrated on an enlarged scale in FIG. 37, the unloading mechanism 298 includes a fluid actuated cylinder 392 supported slantingly on a mount 391 lying on that side of the feed path 292 where the guide rail 324 is provided. The slanting attitude of the cylinder 392, oriented at right angles to the feed path, is such that its rod end is higher than its head end. The piston rod 394 of this cylinder is coupled to a holder 396 which, in this particular embodiment of the invention, rotatably holds three pusher rolls 398 in axial alignment. A pair of rods 402 secured to the opposite ends of the roll holder 396 are slidably fitted in respective guide sleeves 404 on the mount 391 in order to maintain the roll holder in parallel relation to the feed path 292.

Thus, upon extension of the cylinder 392, the pusher rolls 398 move into simultaneous engagement with the bottom ends of the filled and capped packages on the three consecutive carriers traveling on the feed path 292 in engagement with the feed screw 322. The continued extension of the cylinder 392 causes the pusher rolls 398 to dislodge the packages from the open, higher sides of the carriers 326, as will be understood from a consideration of FIG. 34. The dislodged packages fall onto a delivery conveyor 400 and is thereby transported in the direction of the arrow P.

Referring again to FIG. 32, a washer 406 is disposed downstream of the unloading mechanism 298 for washing the unloaded package carriers as they pass therethrough. A dryer 408 lies further downstream of the washer 406 for drying the washer package carriers. Thus reconditioned, the package carriers return to the position by the side of the loading conveyor 302.

FIG. 32 also shows a high frequency oscillator 410 for the induction heating of the seal 286 (FIG. 21 or 22) incorporated in the dispenser mechanism 266 or 266*a* attached to the fitment of each package, as the package emerges from the capping mechanism 296. Thus heated by an induced electric current, the seal 286 will be fused at its peripheral portion to the fitment 70 or 70*a* and to the spout 268 or 268*a*, thereby sealing each package.

It should be appreciated that the BIB packages are supported on the individual carriers in a manner well calculated to preclude the possibility of accidental dislodgement or displacement in the filling and capping apparatus described hereinabove. Accordingly, although the packages themselves are light in weight and rather unstable in shape, they can be fed securely along the predetermined path to expedite their filling and capping operations.

What is claimed is:

1. A bag-in-box package comprising:

(a) a box including:

(1) a set of four panels connected together and forming a rectangular tube, (2) a set of four top flaps hingedly connected to the respective panels and conjointly closing one end of the rectangular tube, (3) a set of four bottom flaps also hingedly connected to the respective panels and conjointly closing the other end of the rectangular tube, and (4) adhesive means retaining the panels, the top flaps, and the bottom flaps in the noted positions;

(b) a bag disposed within the box and formed by two substantially rectangular, superposed layers of flexible material hermetically sealed together, the bag being inflated into close internal contact with the box;

(c) a fitment attached to one of the layers of the bag and projecting outwardly of the box;

(d) additional adhesive means securing one of the layers of the bag at least to one of the inside surfaces of the box in the vicinity of said fitment; and (e) a dispenser mechanism including:

(1) a spout firmly engaged with the fitment, (2) a cap removably engaged with the spout, (3) a seal interposed between the fitment and the spout for sealingly closing the fitment, and (4) an opener member removably placed in the space formed by the spout and the cap.

2. The bag-in-box package according to claim 1, wherein the fitment projects outwardly of the box through one of the panels.

3. The bag-in-box package according to claim 1, wherein the box further comprises a bevel flap hingedly connected between one of the panels and the corresponding one of the top flaps, and wherein the fitment projects outwardly of the box through the bevel flap.

4. A bag-in-box package comprising:

(a) a box including:

(1) a set of first, second, third and fourth panels connected together and forming a rectangular tube, the first panel being between the second and third panels, (2) a set of first, second, third and fourth top flaps hingedly connected to said first, second, third and fourth panels, respectively, and conjointly closing one end of the rectangular tube, said first top flap including a bevel flap portion disposed adjacent to the first panel and having a hole formed therein, (3) a set of first, second, third and fourth bottom flaps also hingedly connected to the first, second, third and fourth panels and conjointly closing the other end of the rectangular tube, and (4) said panels, the top flaps and the bottom flaps being retained adhesively in the noted positions;

(b) a bag disposed within the box and formed by two substantially rectangular, superposed layers of flexible material hermetically sealed together, the bag being inflated into close internal contact with the box;

(c) a fitment attached to one of the layers of the bag and projecting outwardly of the box through said hole of the bevel flap;

(d) first adhesive means comprising two substantially parallel lines extending on the inside surfaces of the first panel and the bevel flap, on opposite sides of said hole in the bevel flap, securing one of the layers of the bag to the inside surfaces of the first panel and the bevel flap;

(e) second adhesive means comprising a line extending on the inside surfaces of the second panel and the second bottom flap along one lateral edge of one rectangular layer of the bag securing said one layer of the bag to the inside surfaces of the second panel and the second bottom flap;

(f) third adhesive means comprising a line extending on the inside surfaces of the third panel and the third bottom flap along the other lateral edge of the one rectangular layer of the bag securing said one layer of the bag to the inside surfaces of the third panel and the third bottom flap; and (g) wherein the inside surfaces of the fourth panel, the fourth bottom and top flaps, the second and third top flaps and the first bottom flap are not secured to the bag.

* * * * *